US012601488B2

(12) United States Patent
Naik et al.

(10) Patent No.: US 12,601,488 B2
(45) Date of Patent: Apr. 14, 2026

(54) PREMIXER ARRAY

(71) Applicant: General Electric Company, Schenectady, NY (US)

(72) Inventors: Pradeep Naik, Bengaluru (IN); Gregory A. Boardman, Owens Cross Roads, AL (US); Vishal Sanjay Kediya, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 17/367,036

(22) Filed: Jul. 2, 2021

(65) Prior Publication Data

US 2023/0003385 A1 Jan. 5, 2023

(51) Int. Cl.
*F23R 3/28* (2006.01)
*F23R 3/12* (2006.01)

(52) U.S. Cl.
CPC ..... *F23R 3/286* (2013.01); *F23R 3/12* (2013.01)

(58) Field of Classification Search
CPC ..... F23R 3/14; F23R 3/12; F23R 3/34–346
See application file for complete search history.

(56) References Cited

U.S. PATENT DOCUMENTS 4,928,479 A 5/1990 Shekleton et al.
5,400,587 A 3/1995 Keller et al.
5,421,158 A 6/1995 Stenger et al.
6,363,726 B1 4/2002 Durbin et al.
7,997,058 B2 8/2011 Farhangi et al.
8,276,385 B2 10/2012 Zuo et al.
8,322,143 B2 12/2012 Uhm et al.
8,424,311 B2 4/2013 York et al.
8,539,773 B2 9/2013 Ziminsky et al.
8,789,374 B2 7/2014 Hoke
9,134,023 B2 9/2015 Boardman et al.
9,151,503 B2 10/2015 Melton et al.
10,295,190 B2 * 5/2019 Boardman ..... F23R 3/10
10,352,569 B2 7/2019 Boardman et al.
10,465,909 B2 * 11/2019 Boardman ..... F23R 3/286
10,502,425 B2 12/2019 Boardman et al.
10,890,329 B2 1/2021 Boardman et al.
2012/0258409 A1 * 10/2012 Mansour ..... F23R 3/286 431/2
2014/0318135 A1 * 10/2014 Knapp ..... F23R 3/46 60/737
2017/0248318 A1 8/2017 Kulkarni
2020/0025385 A1 1/2020 Boardman et al.

* cited by examiner

*Primary Examiner* — Gerald L Sung
*Assistant Examiner* — Jingchen Liu
(74) *Attorney, Agent, or Firm* — Venable LLP; Michael C. Sanko; Michele V. Frank

(57) ABSTRACT

A premixer array for a gas turbine engine includes a plurality of swirled premixer tubes and a plurality of non-swirled premixer tubes. The premixer array further includes a pilot tube for providing a pilot product. The plurality of swirled premixer tubes may guide and spread out the pilot product in a radial direction, in a circumferential direction, or both in a radial direction and a circumferential direction. The plurality of swirled premixer tubes may include clockwise swirled and counterclockwise swirled premixers. Also, included is a method of controlling the flow of pilot products.

14 Claims, 23 Drawing Sheets

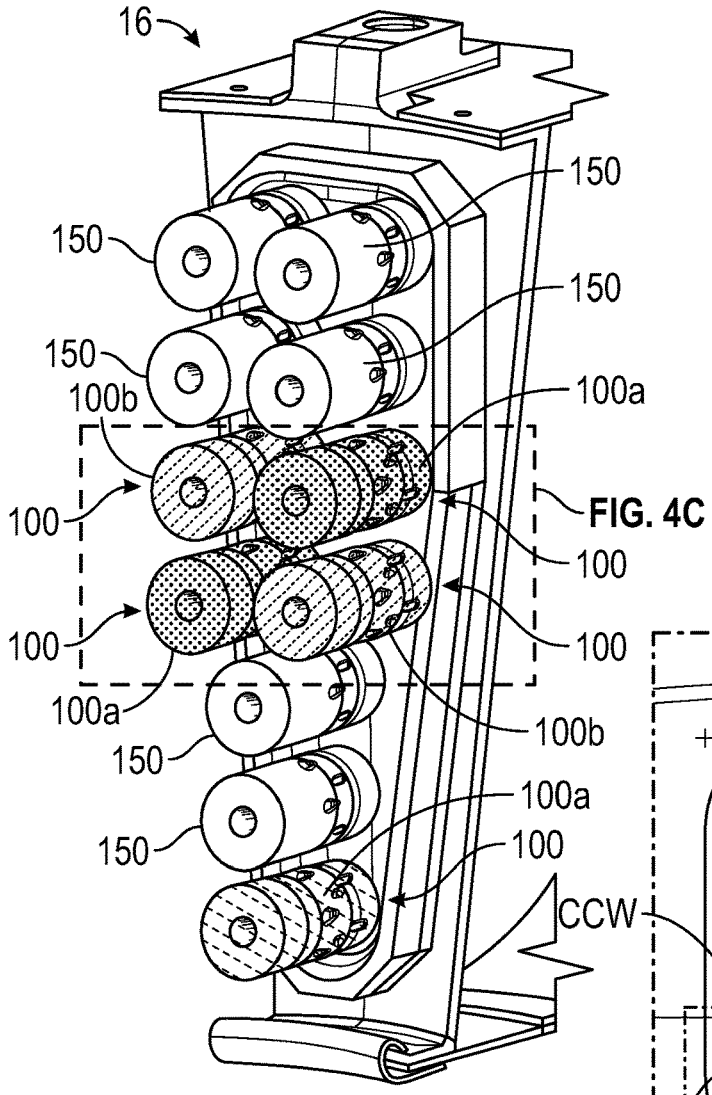
FIG. 4C
FIG. 4A
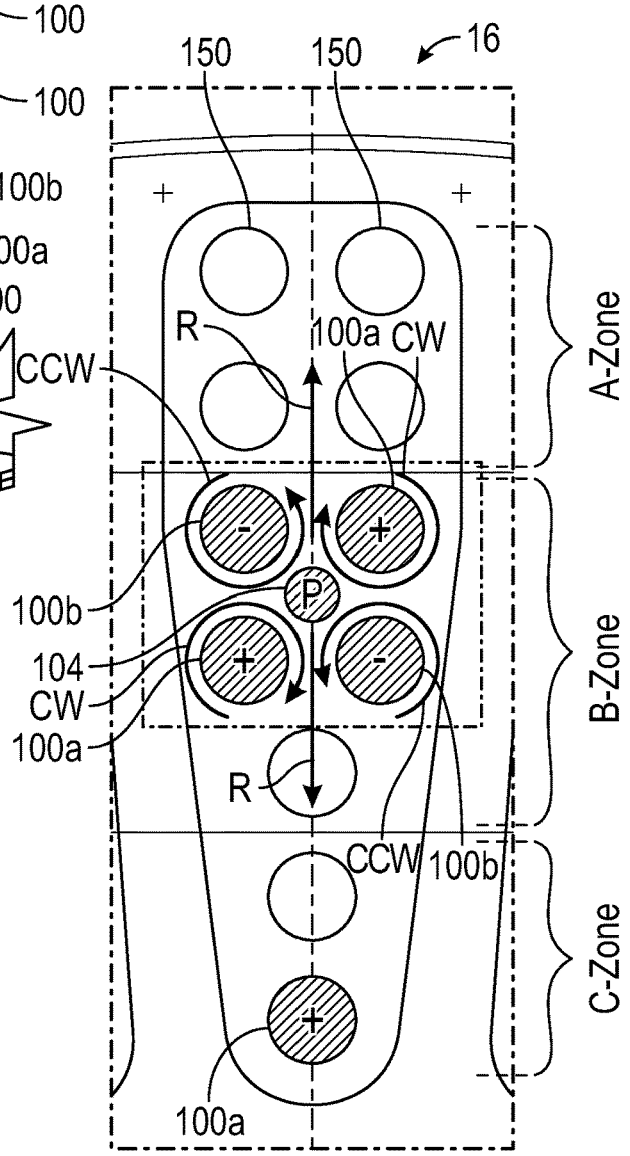
FIG. 4B

PREMIXER ARRAY

TECHNICAL FIELD

The present disclosure relates to a premixer array for an engine. More particularly, the present disclosure relates to a premixer array including swirled premixers.

BACKGROUND

Conventional mixers for natural gas-powered turbine engines blend fuel with air to create a fuel-air mixture that is provided to a combustor of the engine. The conventional mixers mix inlet air and inlet fuel to create the fuel-air mixture. The inlet air may be introduced to the combustor without imparting a swirl.

BRIEF SUMMARY

According to an embodiment, a premixer array for a combustion section of a gas turbine engine includes one or more pilot tubes configured to cause a pilot product to flow and a plurality of swirled premixer tubes. The plurality of swirled premixer tubes being configured to guide and to spread out the pilot product in a radial direction, in a circumferential direction, or both in the radial direction and the circumferential direction.

According to an embodiment, a premixer array for a combustion section of an engine includes a plurality of swirled premixer tubes having one or more tangential openings and being configured for providing a swirled flow to a fuel-air mixture therethrough. The premixer array further includes one or more non-swirled premixer tubes omitting the one or more tangential openings and being configured for providing a non-swirled flow to a fuel-air mixture therethrough. The swirled flow is in a clockwise direction when the one or more tangential openings are angled in a clockwise direction or in a counterclockwise direction when the one or more tangential openings are angled in a counterclockwise direction.

According to an embodiment, a method of controlling a flow of pilot products from a pilot tube includes providing an opposed fuel-air mixture flow from a clockwise fuel-air mixture flow and a counterclockwise fuel-air mixture flow in a mixer array, providing a flow of pilot products in the mixer array, guiding, with the opposed fuel-air mixture flow, the flow of pilot products in a radial direction, in a circumferential direction, or in both a radial direction and a circumferential direction, and spreading, with the opposed fuel-air mixture flow, the flow of pilot products.

Additional features, advantages, and embodiments of the present disclosure are set forth or apparent from a consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

FIG. 4A shows a perspective view of a premixer array, according to an embodiment of the present disclosure.

FIG. 4B shows a schematic front view of the premixer array of FIG. 4A, according to an embodiment of the present disclosure.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

The premixer arrays of the present disclosure provide combinations of co-flowing premixers and counter-flowing premixers to control the direction of flow of pilot products. In some examples, premixers with counterclockwise swirl may be placed adjacent to premixers of clockwise swirl to guide the pilot products radially and/or circumferentially. In some examples, a subset of premixers may guide the pilot products. In some examples, the premixers may guide the pilot products to nearby premixers or adjacent (e.g., directly next to) premixers. The direction of swirl may be achieved by angling the tangential openings of the premixer in a counterclockwise manner or a clockwise manner. The arrangement of premixers may be selected within a premixer zone, between adjacent premixer zones, between adjacent premixer arrays, between multiple premixer arrays, or any combination thereof.

Figure 1A:
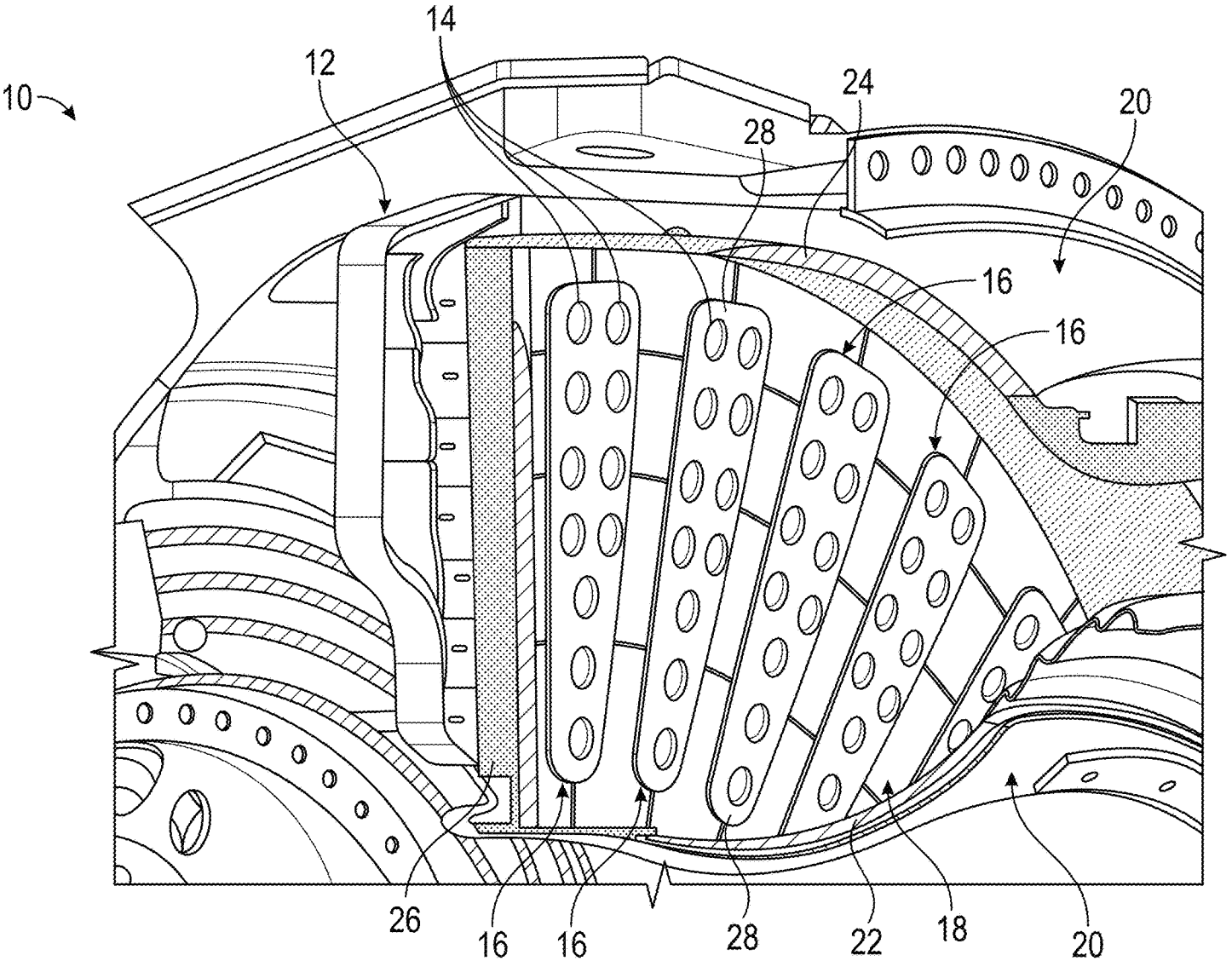
FIG. 1A shows a mixer having a plurality of premixer arrays, according to an embodiment of the present disclosure.
Figure 1B:
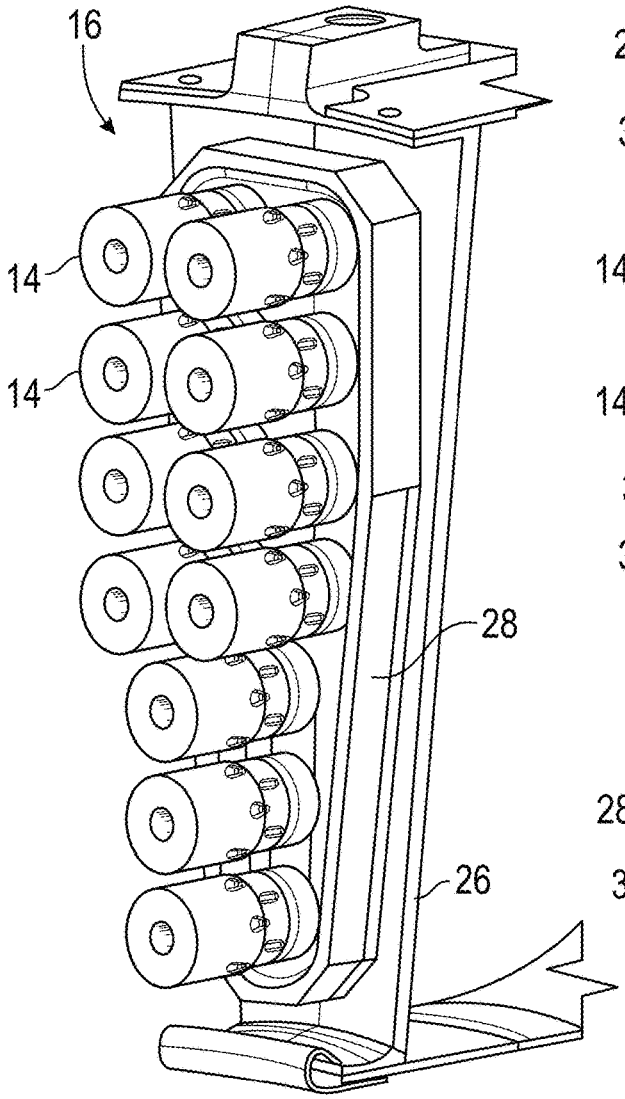
FIG. 1B shows a perspective view of a premixer array, according to an embodiment of the present disclosure.
Figure 1C:
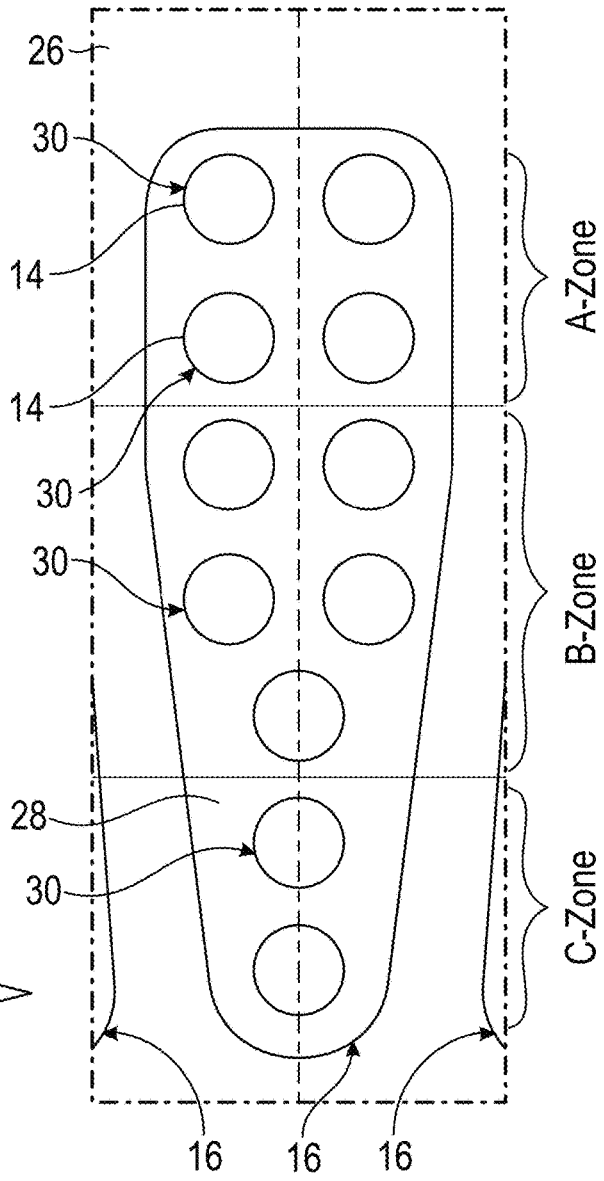
FIG. 1C shows a schematic front view of the premixer array of FIG. 1B, according to an embodiment of the present disclosure.

FIG. 1A shows an engine 10 having a mixer 12. The engine 10 may be, for example, a gas turbine engine. The mixer 12 may include a plurality of premixers 14 arranged in one of a plurality of premixer arrays 16. The mixer 12 may be configured to facilitate mixing of an air flow and a fuel flow through the engine 10 for providing to a combustion section 18 having a combustion liner 20 that includes an inner liner 22 and an outer liner 24. A bulkhead wall 26 of the combustion section 18 extends between the inner liner 22 and the outer liner 24. Each of the premixer arrays 16 includes a premixer array mounting plate 28 coupled to the bulkhead wall 26. Although eleven premixers 14 are shown in each premixer array 16, more or fewer may be provided. Only a portion of the engine 10 and mixer 12 are shown and it may be understood that the engine 10 and mixer 12 are revolved around a centerline, such that the mixer 12 takes a generally annular or donut shape and the plurality of premixer arrays 16 is arranged in a circumferential direction of the mixer 12. FIGS. 1B and 1C show views of one the plurality of premixer arrays 16. Each of the premixer array mounting plates 28 of the plurality of premixer arrays 16 defines a plurality of tube ports 30 extending therethrough. The plurality of premixers 14 of each of the plurality of premixer arrays 16 may be placed within (or coupled to) the plurality of tube ports 30. The premixers 14 of the premixer array 16 may be divided into zones, such as an A-Zone, a B-Zone, and a C-Zone, as shown in FIG. 1C. As shown in FIG. 1C, the plurality of tube ports 30 of the premixer array mounting plate 28 may extend in each of the A-Zone, the B-Zone, and the C-Zone.

Figure 2A:
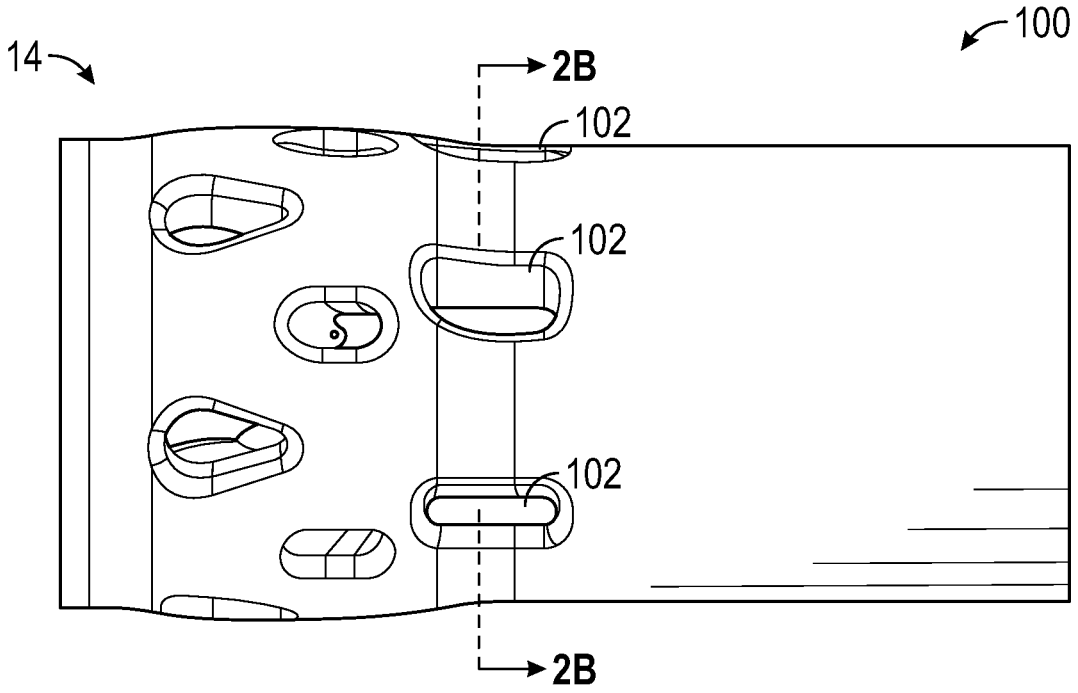
FIG. 2A shows a schematic front view of a premixer for a premixer array, according to an embodiment of the present disclosure.
Figure 2B:
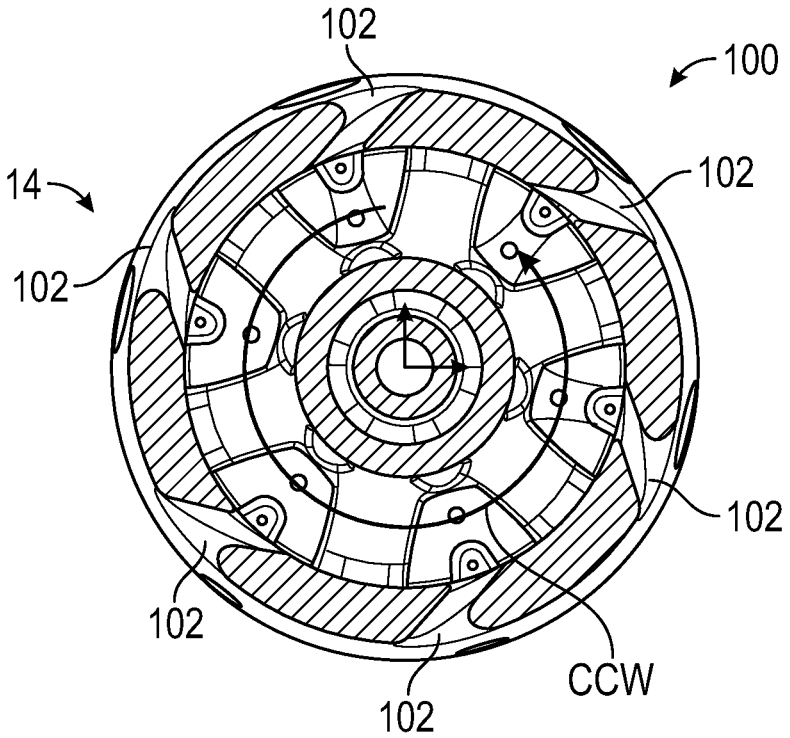
FIG. 2B shows a cross-sectional view of the premixer of FIG. 2A taken along the section line 2B-2B, according to an embodiment of the present disclosure.
Figure 3:
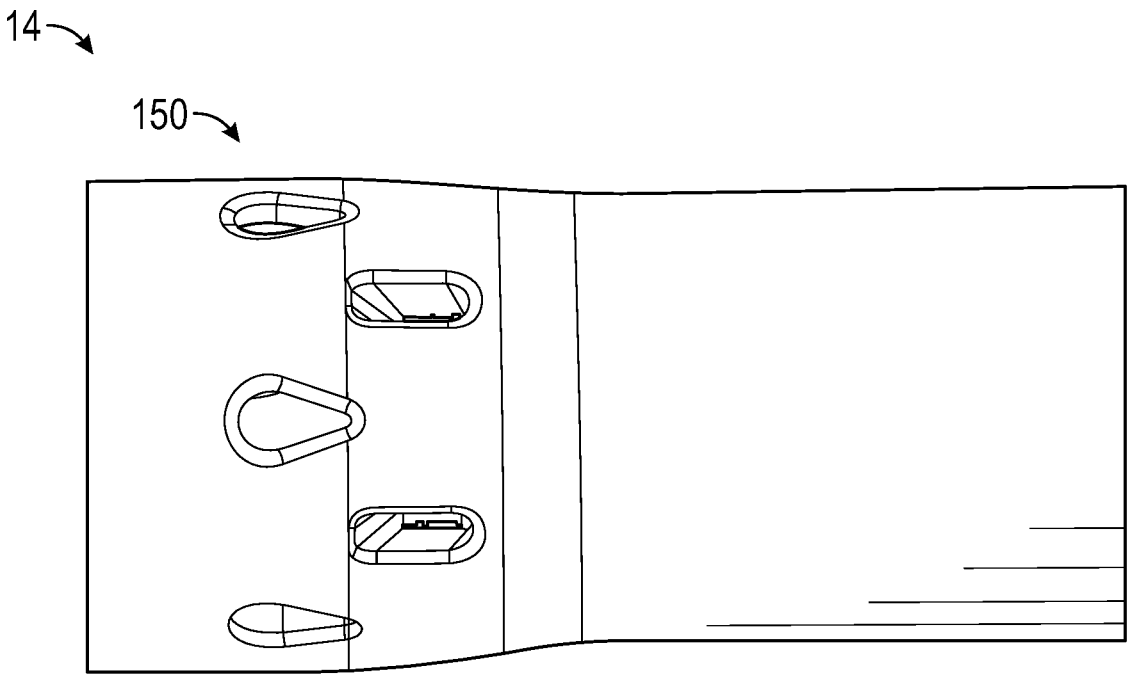
FIG. 3 shows a schematic front view of a premixer for a premixer array, according to an embodiment of the present disclosure.
Figure 4C:
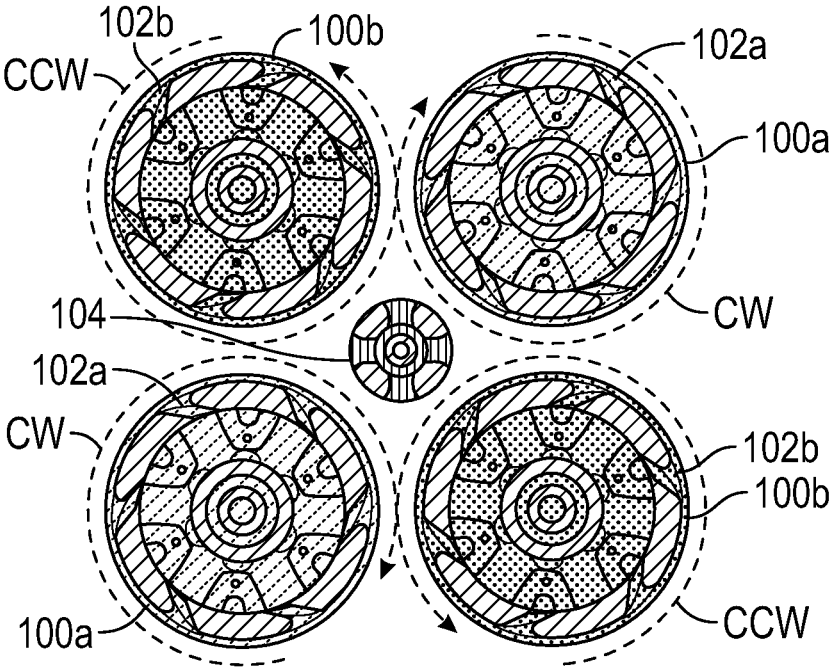
FIG. 4C shows a cross-sectional view of a subset of premixers of the premixer array of FIG. 4A, taken along a section line through the vanes, according to an embodiment of the present disclosure.
Figure 4D:
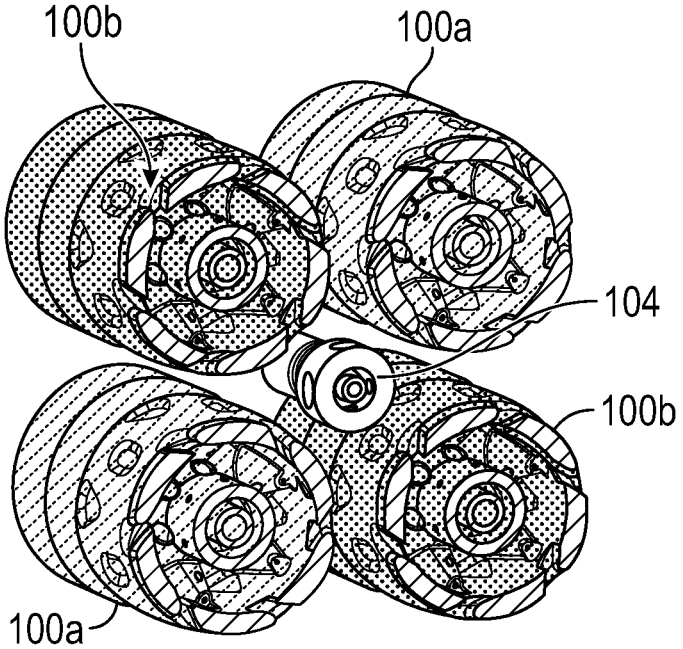
FIG. 4D shows a rear perspective view of the subset of premixers of FIG. 4C, according to an embodiment of the present disclosure.

FIGS. 2A and 2B and FIG. 3 show exemplary premixers 14 for use in the premixer array 16 of FIGS. 1A to 1C. With reference to FIGS. 2A and 2B, the premixer 14 may be a swirled premixer tube 100. The swirled premixer tube 100 may include a plurality of tangential slots 102. The tangential slots 102 may be angled to provide the flow direction in the flow therethrough the swirled premixer tube 100. That is, the tangential slots 102 may be angled to provide a clockwise direction flow CW (see, for example, FIG. 4C) or a counterclockwise direction flow CCW (FIG. 2B). As shown in FIG. 2B, the tangential slots 102 may be angled in a counterclockwise direction to impart the counterclockwise direction flow CCW. As shown in FIG. 4C, the tangential slots 102 may be angled in a clockwise direction to impart the clockwise direction flow CW. The degree to which the tangential slots 102 are angled with respect to a normal axis through the swirled premixer tube 100 may be selected based on the desired flow therethrough. The swirled premixer tube 100 may impart flow direction and turbulence to the flow therethrough.

Referring to FIG. 3, the premixer 14 may be a non-swirled premixer tube 150. The non-swirled premixer tube 150 may omit the tangential slots 102 of FIGS. 2A and 2B. Thus, the flow through the non-swirled premixer tube 150 may not be intentionally directed in a clockwise direction or a counterclockwise direction. Any combination of swirled premixer tubes 100 and non-swirled premixer tubes 150 may be provided in each premixer array 16 of the mixer 12, as will be described in the following disclosure.

Providing swirled premixer tubes 100 in the premixer array 16 may provide flame stability to various zones (e.g., A-Zone, B-Zone, and/or C-Zone) of the premixer array 16, may create a shear layer between adjacent premixers 14, which may achieve enhanced mixing (as compared to non-swirled premixers) and lower $NO_x$ emissions, and may create a secondary flow structure (e.g., a swirling flow), that may help to reduce combustion dynamics. Including swirled premixer tubes 100 in the premixer array 16 may reduce or eliminate circumferential flow within the mixer 12.

FIG. 4A to FIG. 16C show exemplary arrangements of swirled premixer tubes 100 and non-swirled premixer tubes 150 located in the couplets of the premixer array 16. Any combination of clockwise swirled premixer tubes, counterclockwise swirled premixer tubes, and non-swirled premixer tubes may be provided in the premixer arrays 16 of the present disclosure based on the desired flow and mixing through the engine 10 (FIG. 1A). Although a single premixer array 16 is shown in some examples, a plurality may be provided such as shown in FIG. 1A. The premixer arrays 16 of FIG. 1A may include one or more of the exemplary arrangements described in FIG. 4A to FIG. 16C, in any combination (e.g., all the same array, all different arrays, mixes of multiple arrays, etc.).

Referring now to FIGS. 4A to 4E, a premixer array 16 may include a plurality of non-swirled premixer tubes 150 and a plurality of swirled premixer tubes 100. The swirled premixer tubes 100 may include clockwise swirled premixer tubes 100*a* and counterclockwise swirled premixer tubes 100*b*. That is, the tangential openings 102*a* may be arranged in a clockwise direction (clockwise swirled premixer tubes 100*a*) and the tangential openings 102*b* may be arranged in a counterclockwise direction (counterclockwise swirled premixer tubes 100*b*). Thus, the tangential openings 102*a* may impart a clockwise swirl on the flow therethrough and the tangential openings 102*b* may impart a counterclockwise swirl on the flow therethrough.

The premixer array 16 of FIGS. 4A to 4E may include a pilot tube 104. The pilot tube 104 may provide a fuel flow to the mixer 12 (FIG. 1A). The fuel flow may be a gas fuel or a liquid fuel, or a combination thereof. The swirled premixer tubes 100 and the non-swirled premixer tubes 150 may provide an air flow to the mixer 12 (FIG. 1A). Thus, the mixer 12 may provide a fuel-air mixture (provided by the combination of air flow from the premixers 14 and the pilot tube(s) 104) to the engine 10 (FIG. 1A).

In operation, and with particular reference to FIG. 4B, a fuel flow may be provided through the pilot tube 104. The pilot tube 104 may be a swirling tube or a non-swirling tube. At the exit of the pilot tube 104, the fuel flow may interact with an air-fuel mixture flow from the swirled premixer tubes 100. FIG. 4B shows a subset of swirled premixer tubes 100 that form a square in plan view. The pilot tube 104 may be located at a center of the square in plan view and, thus, at a center of the subset of swirled premixer tubes 100.

As shown in FIG. 4B, the swirled premixer tubes 100 on the top side of FIG. 4B in the B-Zone may be arranged such that the top right premixer is a clockwise swirled premixer tube 100*a* and the top left premixer is a counterclockwise swirled premixer tube 100*b*. This may generate a combined premixer fuel-air mixture flow that acts to move the pilot fuel or fuel-air mixture flow or pilot products to flow in a radial outward direction R (e.g., in a radial direction with respect to the engine 10 of FIG. 1A. This may also be referred to as an axial direction of the premixer array 16) to provide a flow 106 (FIG. 4E) of fuel-air mixture or combustion products in the radially outward direction and radially inward direction. A similar action is achieved on the bottom side of FIG. 4B in the B-Zone by arranging the bottom left premixer as a counterclockwise swirled premixer tube 100*b* and the bottom right premixer as a clockwise swirled premixer tube 100*a*. This arrangement may cause pilot products to move radially inward in the direction R. Thus, when two adjacent premixers are arranged with opposing flows (e.g., one arranged clockwise and one arranged counterclockwise), the fuel-air mixture flow from the premixer may meet and pull the pilot fuel or fuel-air mixture flow or products of combustion from pilot along therewith. That is, adjacent swirled premixer tubes 100 may be arranged to flow in opposing directions. The adjacent swirled premixer tubes 100 may be arranged to cause the pilot products to flow in a radially outward direction and/or a radially inward direction. Thus, as shown in FIG. 4B, the top two premixers of the B-Zone pulls the fuel flow radially outward and the bottom two premixers of the B-Zone pulls the fuel flow radially inward. Such an arrangement may reduce or prevent circumferential flow of the pilot fuel or combustion product from pilot (e.g., fuel or pilot combustion product to the left and right as viewed in FIG. 4B) and induce the combustion products from pilot to move towards A-Zone or C-Zone thereby providing flame stability to the premixers in A-Zone and C-Zone that do not have a pilot 104. Including a swirled premixer in the C-Zone may further pull the now fuel-air mixture in the desired direction. Although shown in FIG. 4B as a clockwise swirled premixer tube 100*a*, this may be a counterclockwise swirled premixer tube 100*b*. A swirled premixer tube provided in the C-Zone or in the upper A-zone may assist in reducing a re-circulation zone closer to the combustion liner 20 (FIG. 1A), which is typically seen with non-swirling premixer. Reducing the corner re-circulation zone closer to the combustion liner 20 helps in reducing flame quenching effect and maintaining a shortened flame for premixers those are near the inner liner or the outer liner of the combustion zone.

Figure 4E:
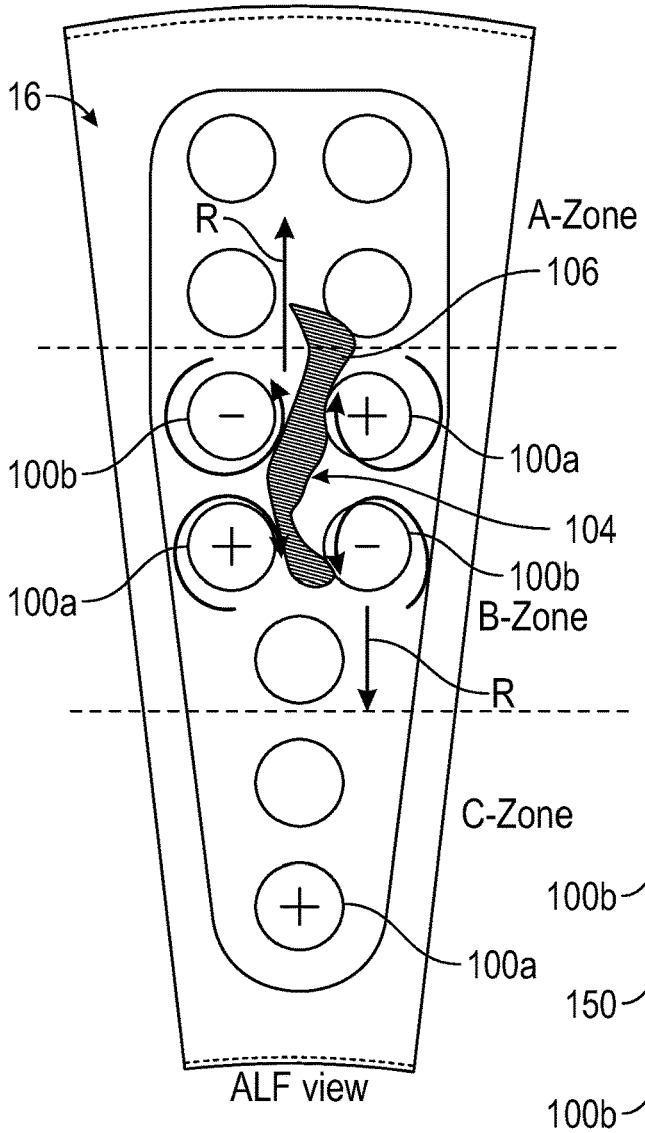
FIG. 4E shows a schematic front view of the premixer array of FIG. 4A, according to an embodiment of the present disclosure.
Figure 5A:
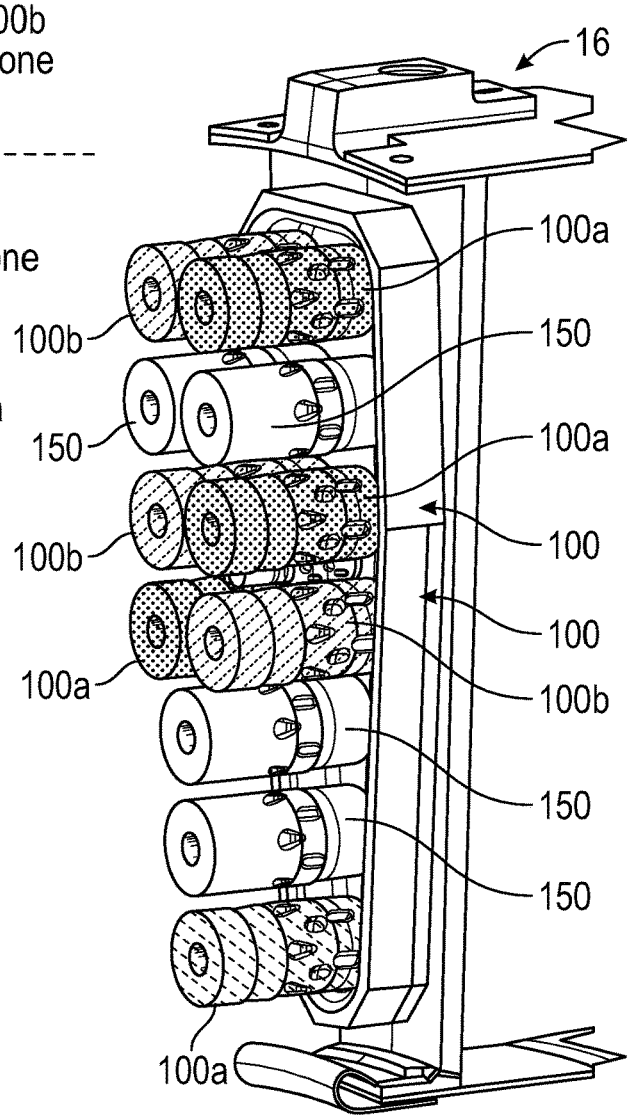
FIG. 5A shows a perspective view of a premixer array, according to an embodiment of the present disclosure.
Figure 5B:
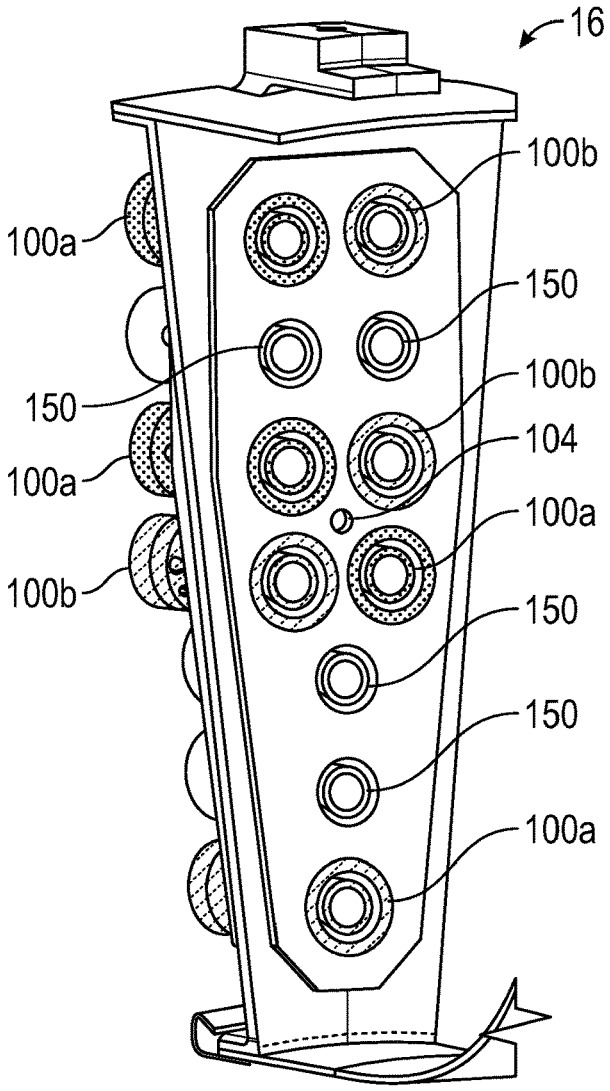
FIG. 5B shows a rear perspective view of the premixer array of FIG. 5A, according to an embodiment of the present disclosure.
Figure 5C:
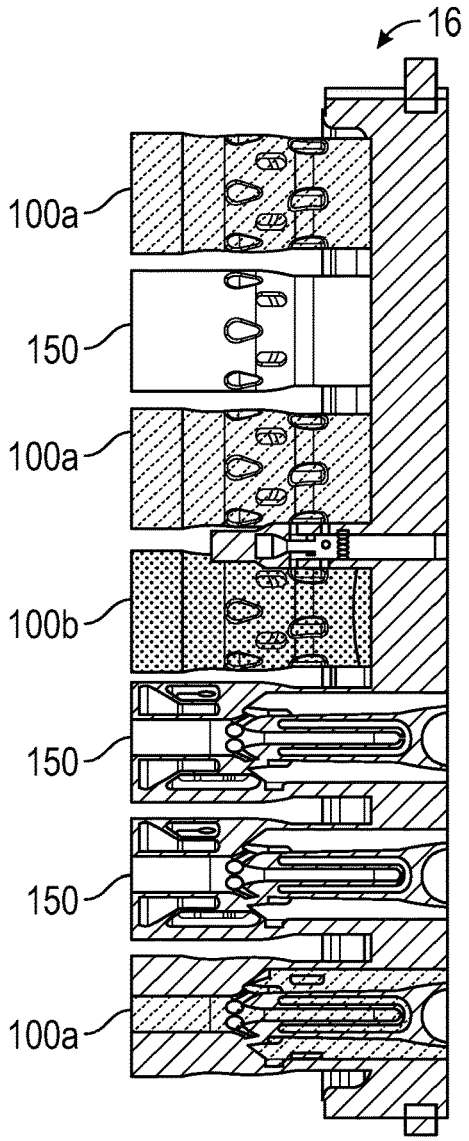
FIG. 5C shows a cross-sectional view of the premixer array of FIG. 5A, taken along a centerline of the premixer array, according to an embodiment of the present disclosure.
Figure 5D:
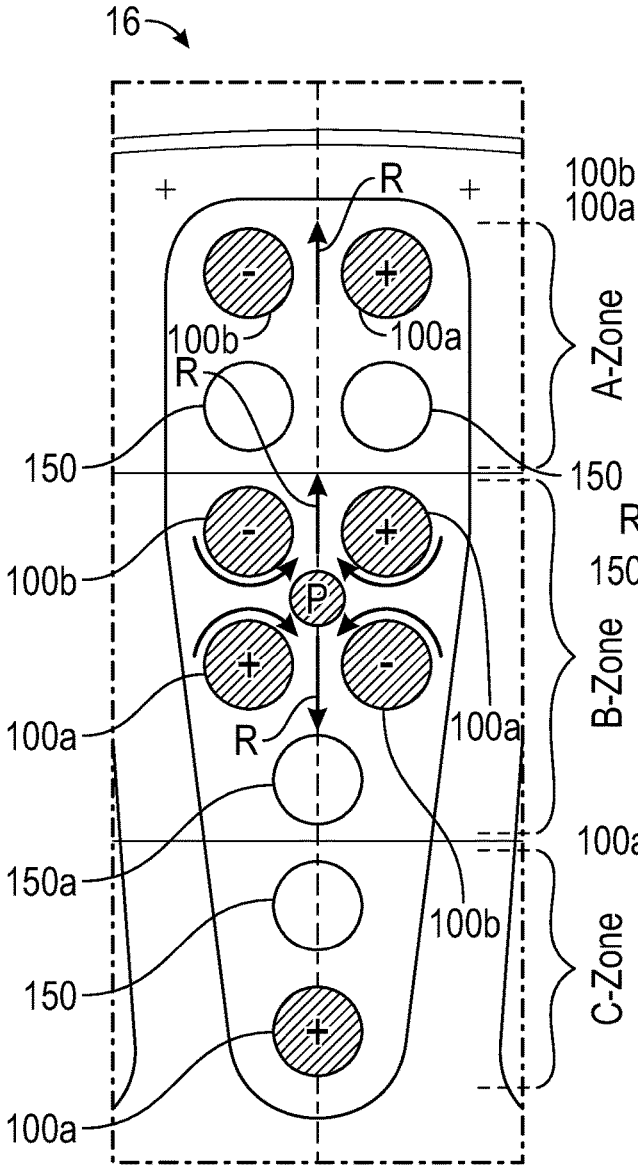
FIG. 5D shows a schematic front view of the premixer array of FIG. 5A, according to an embodiment of the present disclosure.

Accordingly, the opposing flow of the swirled premixer tubes 100 may move the pilot products in a selected direction or a predetermined direction. This arrangement may be used to induce the pilot products to flow from the pilot tube to the main mixer and, thus, to the engine. Directing the pilot products in the desired direction may allow for the premixer array 16 to achieve enhanced mixing and lower $NO_x$ emissions as compared to premixer arrays that do no employ such directing of pilot products. As shown in FIG. 4E, the pilot products are induced to flow radially towards A-Zone and C-Zone and circumferential flow is limited.

Referring now to FIGS. 5A to 5D, a premixer array 16 may include a plurality of non-swirled premixer tubes 150 and a plurality of swirled premixer tubes 100. The swirled premixer tubes 100 may include clockwise swirled premixer tubes 100*a* and counterclockwise swirled premixer tubes 100*b*. The arrangement in the B-Zone and the C-Zone of the premixer array 16 of FIGS. 5A to 5D may be the same as in the premixer array 16 of FIGS. 4A to 4E. Additionally, the premixer array 16 of FIGS. 5A to 5D, may include swirled premixer tubes 100 in the A-Zone. The top two premixers in the A-Zone may be swirled premixer tubes 100. The swirled premixer tubes 100 in the A-Zone may be arranged in opposing flows, e.g., one clockwise swirled premixer tube 100*a* (on the right in FIG. 5D) and one counterclockwise swirled premixer tube 100*b* (on the left in FIG. 5D). The addition of swirled premixer tubes 100 in the A-Zone may reduce the corner circulation zone and may prevent flame straining. That is, the swirled premixer tubes 100 in the A-Zone may cause the premixer products closer to the periphery to flow in the direction R to clear the recirculation zone. The addition of swirled premixer tubes 100 in the C-Zone may maintain a shorter flame near the combustion liner 20 (FIG. 1A). The addition of swirled premixer tubes 100 in the B-Zone may induce pilot products from the pilot tube 104 to flow in the direction R toward the A-Zone and to, for example, the fifth premixer in the B-Zone (e.g., the non-swirled fifth premixer tube 150*a*).

Figure 6:
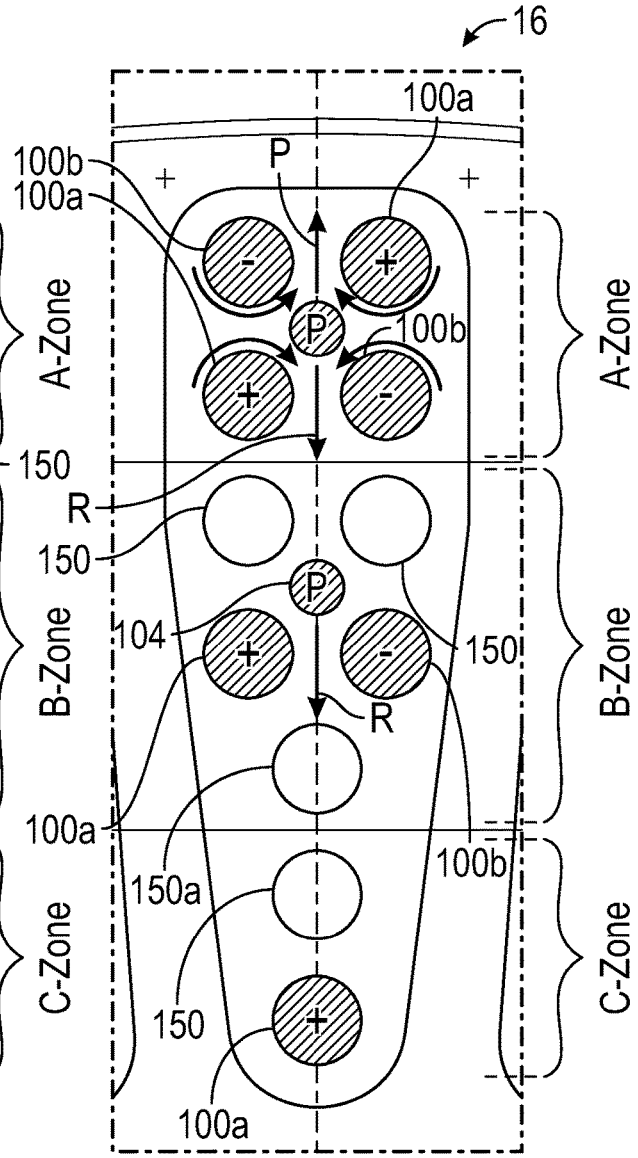
FIG. 6 shows a schematic front view of a premixer array, according to an embodiment of the present disclosure.

FIG. 6 shows an exemplary arrangement of swirled premixer tubes 100, non-swirled premixer tubes 150, and pilot tubes 104 in a premixer array 16. In FIG. 6, the A-Zone may include a pilot tube 104 and opposing clockwise swirled premixer tubes 100*a* and counterclockwise swirled premixer tubes 100*b*. The arrangement in the A-Zone may be the same as or similar to the arrangement of the B-Zone in FIGS. 4A to 4E and 5A to 5D. Additionally, in the B-Zone, a pilot tube 104 may be provided in conjunction with a clockwise swirled premixer tube 100*a* and a counterclockwise swirled premixer tube 100*b*. In the C-Zone, a clockwise swirled premixer tube 100*a* may be included, although a counterclockwise swirled premixer tube may alternatively be selected.

The arrangement of FIG. 6 provides the B-Zone swirled premixer tubes 100 that may induce the pilot tube 104 flow in the B-Zone to flow in the direction R to the fifth premixer tube 150*a* in the B-Zone. The A-Zone swirled premixer tubes 100 may induce the product of pilot tube 104 in the A-Zone to flow to the A-Zone main tubes and to the periphery to reduce and/or to clear the recirculation zone. The C-Zone swirled premixer tube 100 may maintain a shorter flame near the combustion liner by reducing corner re-circulation zone near liner and thereby flame straining.

Figure 7:
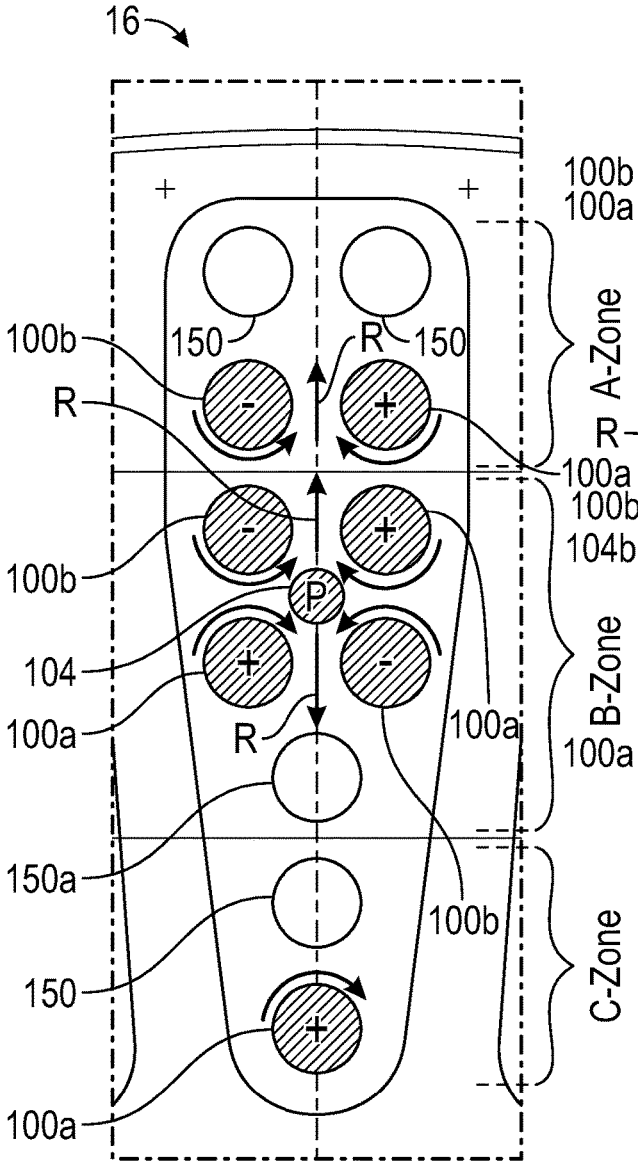
FIG. 7 shows a schematic front view of a premixer array, according to an embodiment of the present disclosure.

FIG. 7 shows an exemplary arrangement of swirled premixer tubes 100, non-swirled premixer tubes 150, and pilot tubes 104 in a premixer array 16. In FIG. 7, the A-Zone may include opposing clockwise swirled premixer tube 100*a* and counterclockwise swirled premixer tube 100*b*. The swirled premixer tubes 100 in the A-Zone may be provided in the lower portion of the A-Zone. The arrangement in the B-Zone may be the same as or similar to the arrangement of the B-Zone in FIGS. 4A to 4E and 5A to 5D. In the C-Zone, a clockwise swirled premixer tube 100*a* may be included, although a counterclockwise swirled premixer tube may alternatively be selected.

The arrangement of FIG. 7 provides the B-Zone swirled premixer tubes 100 that may induce the pilot tube 104 in the B-Zone to flow in the direction R toward the A-Zone and in the direction R toward the fifth premixer tube 150*a*. The swirled premixer tubes 100 in the lower A-Zone may move the pilot product from the B-Zone pilot tube 104 in the direction R toward the outermost A-Zone main mixer. The C-Zone swirled premixer tube 100 may maintain a shorter flame near the combustion liner and may fight or reduce near-wall recirculation.

Figure 8:
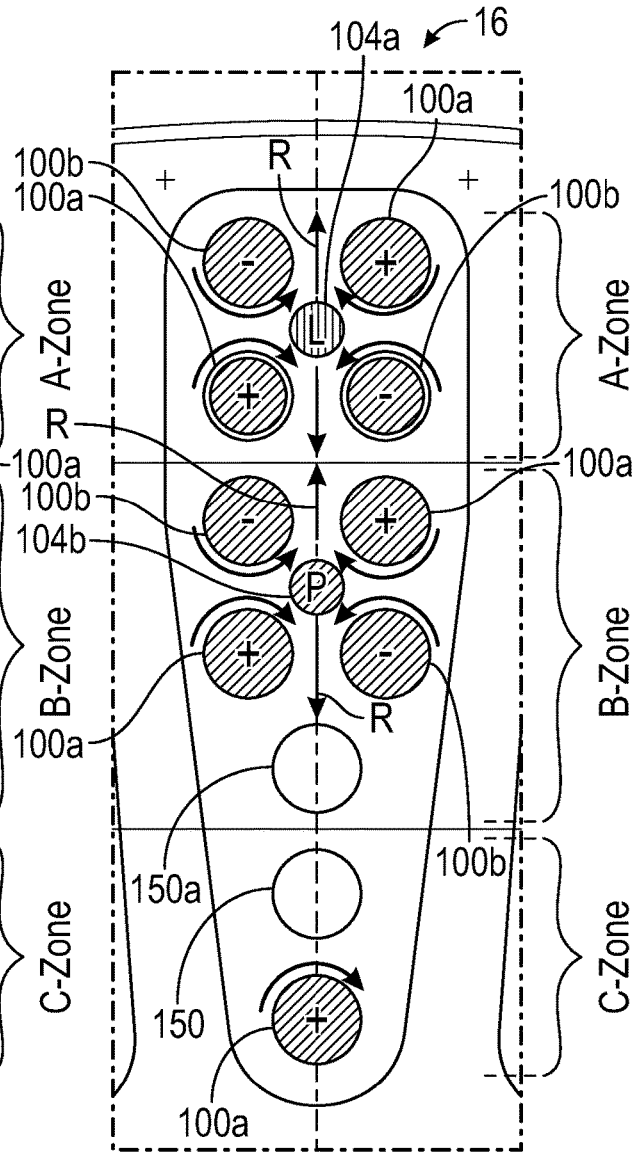
FIG. 8 shows a schematic front view of a premixer array, according to an embodiment of the present disclosure.

FIG. 8 shows an exemplary arrangement of swirled premixer tubes 100, non-swirled premixer tubes 150, and pilot tubes 104 in a premixer array 16. In FIG. 8, the arrangement in the A-Zone and the arrangement in the B-Zone may be the same as or similar to the arrangement of the B-Zone in FIGS. 4A to 4E and 5A to 5D. In the A-Zone, the liquid pilot tube 104*a* may be a liquid pilot and the gas pilot tube 104*b* may be a gas pilot. In the C-Zone, a clockwise swirled premixer tube 100*a* may be included, although a counterclockwise swirled premixer tube may alternatively be selected.

The arrangement of FIG. 8 may include a liquid pilot tube 104*a* in the A-Zone. The swirled premixer tubes 100 in the A-Zone may induce the liquid pilot products to flow toward the A-Zone main mixer. The swirled premixer tubes 100 in the A-Zone may also reduce a corner circulation zone and prevent flame straining. The swirled premixer tubes 100 in the B-Zone may induce the gas pilot tube 104*b* in the B-Zone to flow in the direction R toward the A-Zone and in the direction R toward, for example, the fifth premixer tube 150*a*. The C-Zone swirled premixer tube 100 may maintain a shorter flame near the combustion liner and may fight or reduce near-wall recirculation. In the arrangement of FIG. 8, the liquid pilot tube 104*a* and the gas pilot tube 104*b* may be operated at different time periods. The location of the liquid pilot tube 104*a*, although shown in the A-Zone, may be in the B-zone and/or may be in-between the B-Zone and the C-Zone. The gas pilot tube 104*b*, although shown in the B-Zone, may be in the A-Zone and/or in-between the A-Zone and the B-Zone.

Figure 9:
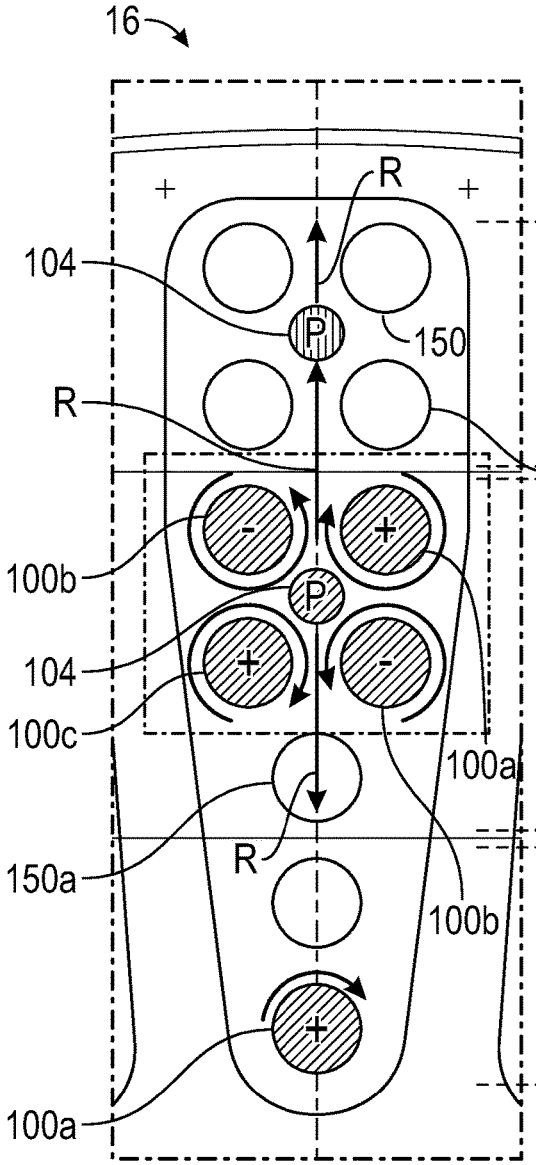
FIG. 9 shows a schematic front view of a premixer array, according to an embodiment of the present disclosure.

FIG. 9 shows an exemplary arrangement of swirled premixer tubes 100, non-swirled premixer tubes 150, and pilot tubes 104 in a premixer array 16. In FIG. 9, the arrangement of the B-Zone may be the same as or similar to the arrangement of the B-Zone in FIGS. 4A to 4E and 5A to 5D. In the A-Zone, a pilot 104 may be included. In the C-Zone, a clockwise swirled premixer tube 100*a* may be included, although a counterclockwise swirled premixer tube may alternatively be selected.

The arrangement of FIG. 9 provides the B-Zone swirled premixer tubes 100 that may induce the pilot tube 104 flow in the B-Zone to flow in the direction R toward the A-Zone and in the direction R toward, for example, the fifth premixer tube 150*a*. The pilot 104 in the A-Zone adds pilot products to the flow and is induced radially outward in the direction R by the B-Zone arrangement. The C-Zone swirled premixer tube 100 may maintain a shorter flame near the combustion liner.

Figure 10:
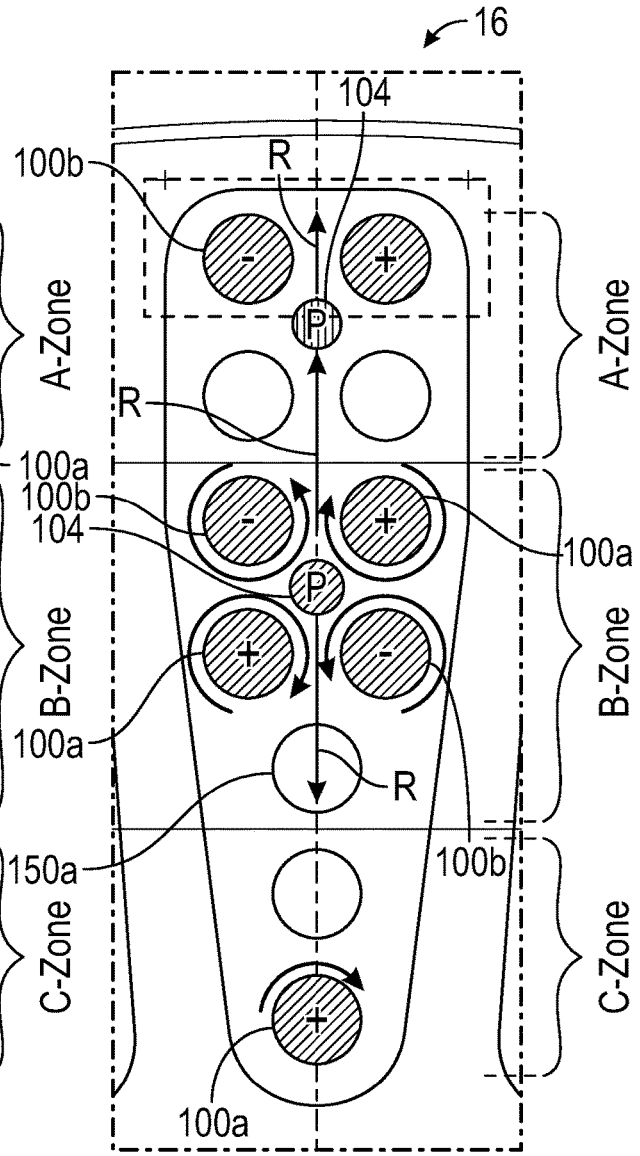
FIG. 10 shows a schematic front view of a premixer array, according to an embodiment of the present disclosure.

FIG. 10 shows an exemplary arrangement of swirled premixer tubes 100, non-swirled premixer tubes 150, and pilot tubes 104 in a premixer array 16. In FIG. 10, the arrangement of the B-Zone may be the same as or similar to the arrangement of the B-Zone in FIGS. 4A to 4E and 5A to 5D. In the A-Zone, a pilot 104 may be included. The A-Zone may also include a pair of opposed direction swirled premixer tubes 100 in the upper portion (e.g., in the upper couplets) of the A-Zone. In the C-Zone, a clockwise swirled premixer tube 100*a* may be included, although a counterclockwise swirled premixer tube may alternatively be selected.

The arrangement of FIG. 10 provides the B-Zone swirled premixer tubes 100 that may induce the pilot tube 104 in the B-Zone to flow in the direction R toward the A-Zone and in the direction R toward, for example, the fifth premixer tube 150*a*. The A-Zone swirled premixer tubes 100 may induce the product of pilot tube 104 in the A-Zone and the B-Zone to flow to the A-Zone main tubes and to the periphery to reduce and/or clear the recirculation zone. The C-Zone swirled premixer tube 100 may maintain a shorter flame near the combustion liner 20 (FIG. 1A).

Figure 11:
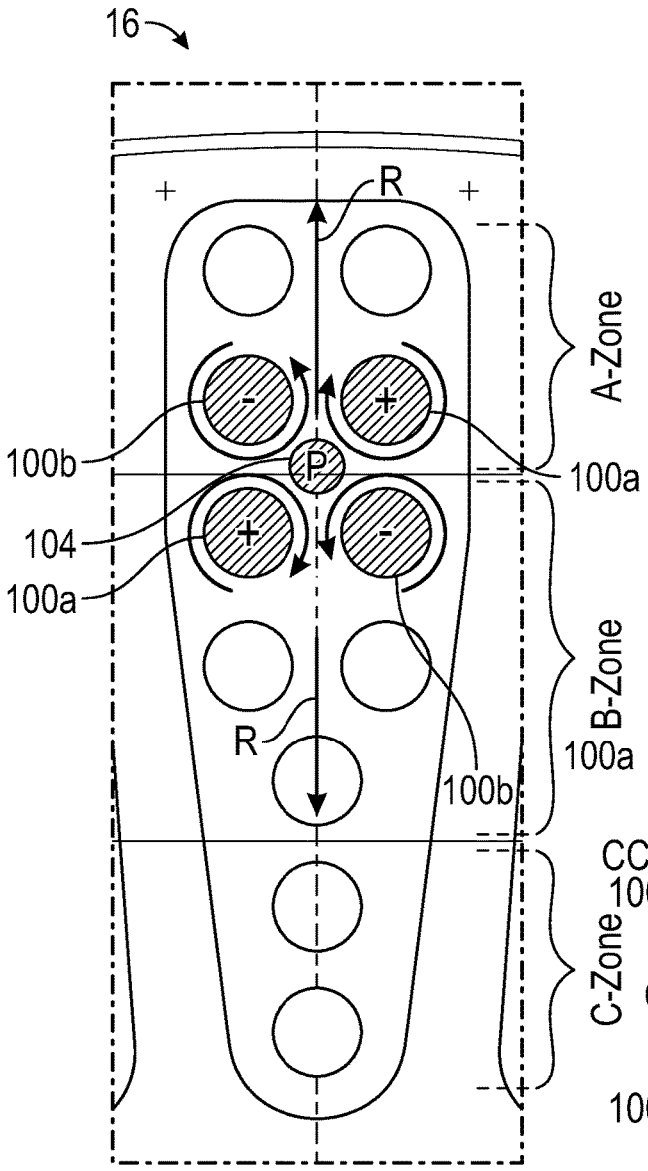
FIG. 11 shows a schematic front view of a premixer array, according to an embodiment of the present disclosure.
Figure 12:
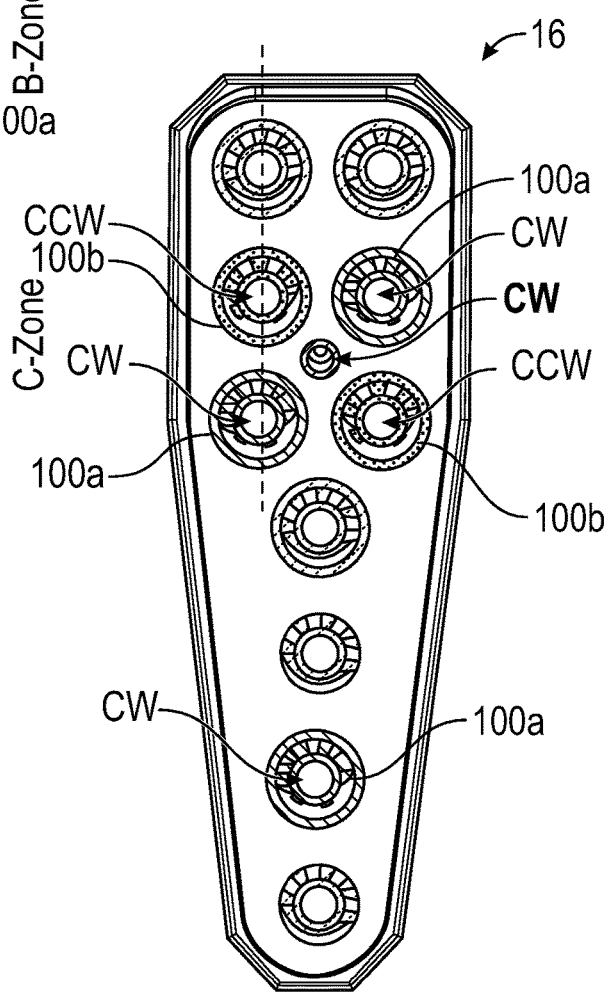
FIG. 12 shows a rear perspective view of a premixer array, according to an embodiment of the present disclosure.

FIG. 11 shows an exemplary arrangement of swirled premixer tubes 100, non-swirled premixer tubes 150, and pilot tube 104 in a premixer array 16. In FIG. 11, the arrangement spanning the lower couplets of the A-Zone and the upper couplets of the B-Zone may be the same as or similar to the arrangement of the B-Zone in FIGS. 4A to 4E and 5A to 5D. The arrangement of FIG. 11 shows the pilot tube 104 placed in-between the A-Zone and the B-Zone and provides swirled premixer tubes 100 in the A-Zone that induce the product of pilot tube 104 to flow to the A-Zone main tubes in the direction R and to the lower couplets in the B-Zone in the direction R. FIG. 12 shows a similar arrangement as that shown in FIG. 11 with the addition of a swirled premixer tube 100 in an upper couplet of the C-Zone.

FIGS. 13 to 16C show exemplary arrangements of adjacent premixer arrays 16. In the premixer arrays 16 of FIGS. 13 to 16C, adjacent premixers 14 may be arranged in a clockwise swirled premixer tube 100*a* and counterclockwise swirled premixer tube 100*b* opposed relationship. This opposed relationship may function as previously described to pull the pilot products in a predetermined direction.

Figure 13:
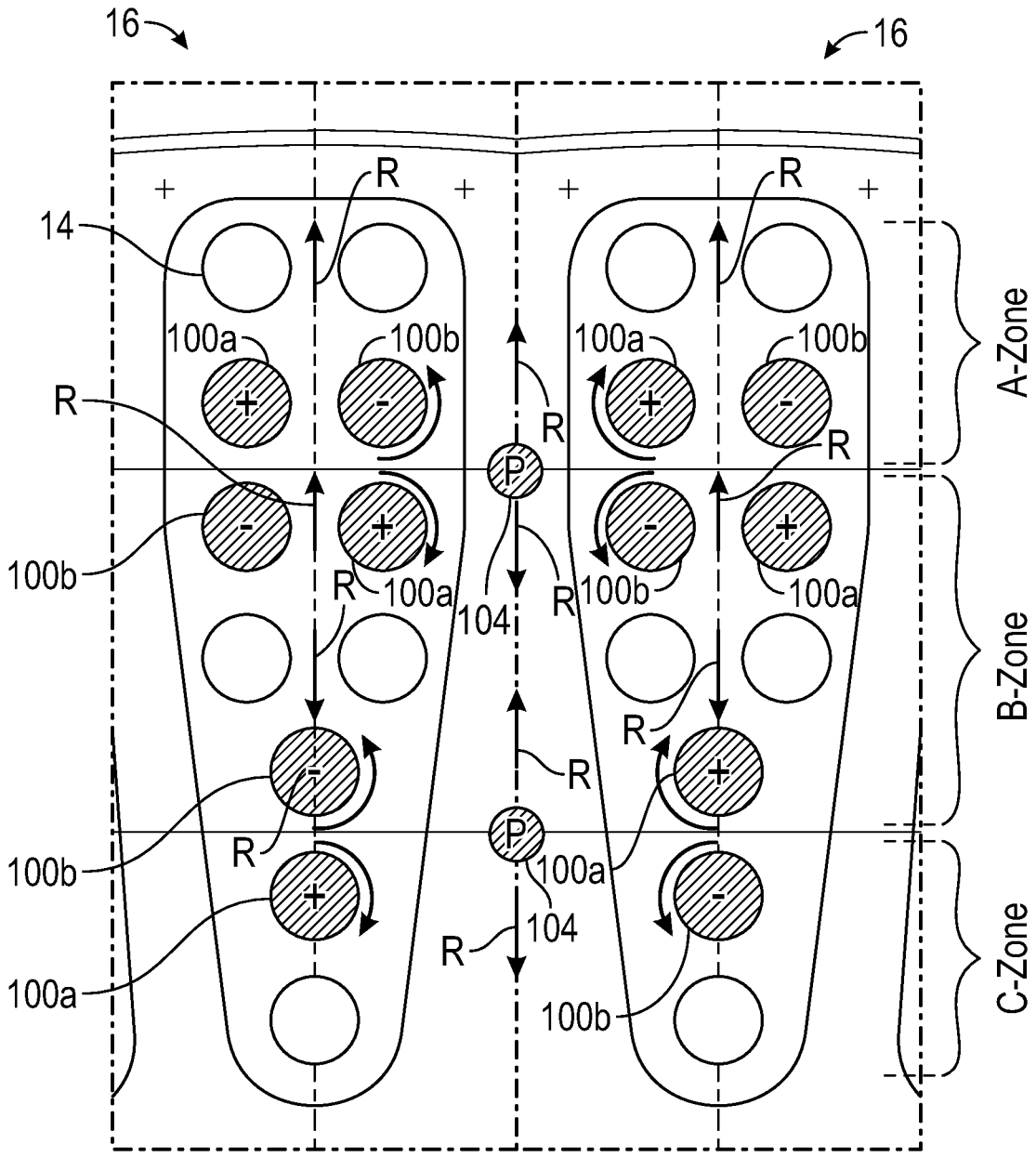
FIG. 13 shows a schematic front view of a plurality of premixer arrays, according to an embodiment of the present disclosure.

In the example of FIG. 13, the pilots 104 may be located between adjacent premixer arrays 16. The swirled premixer tubes 100 located on the right hand side of the left premixer array 16 may interact with the pilot products to move the products in the direction R, as described previously. Similarly, the swirled premixer tubes 100 located on the left hand side of the right premixer array 16 may interact with the pilot products to move the products in the direction R, as described previously. The pilot tube 104 introduced in between two adjacent premixer arrays 16 may cause the pilot combustion products to flow towards the main mixer of an adjacent premixer assembly or to a premixer array for flame stability. The pilot products may flow in the radial direction.

Figure 14:
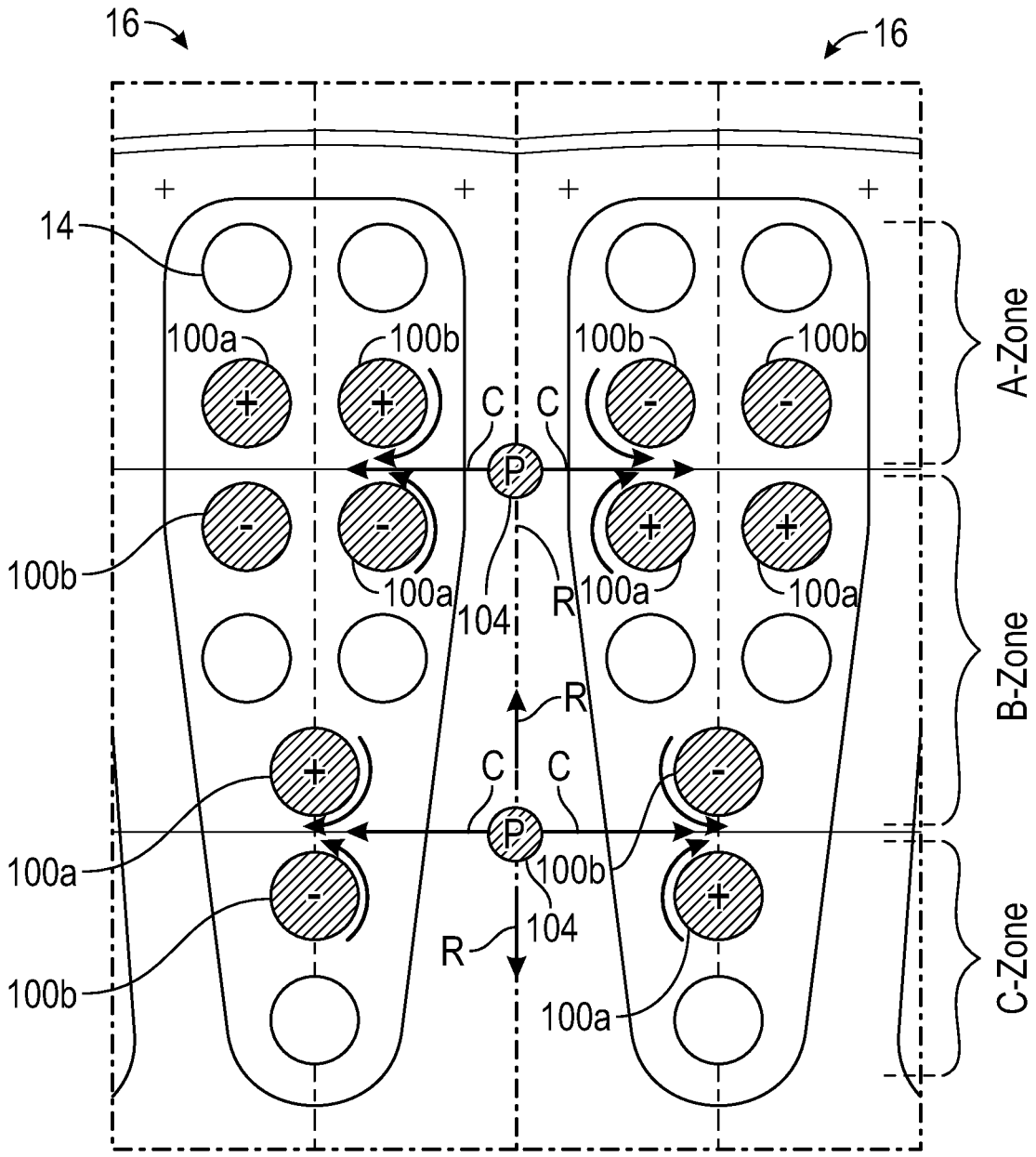
FIG. 14 shows a schematic front view of a plurality of premixer arrays, according to an embodiment of the present disclosure.

In the example of FIG. 14, the pilots 104 may be located between adjacent premixer arrays 16. The swirled premixer tubes 100 located on the right hand side of the left premixer array 16 may interact with the pilot products to move the products in the direction C, e.g., circumferentially around the mixer 12 (FIG. 1A). Similarly, the swirled premixer tubes 100 located on the left hand side of the right premixer array 16 may interact with the pilot products to move the products in the direction C, as described previously. The pilot tube 104 introduced in between two adjacent premixer arrays 16 may cause the pilot combustion products to flow towards the main mixer of adjacent premixer assembly or to a premixer cup for flame stability. The pilot may flow in the circumferential direction.

Figure 15A:
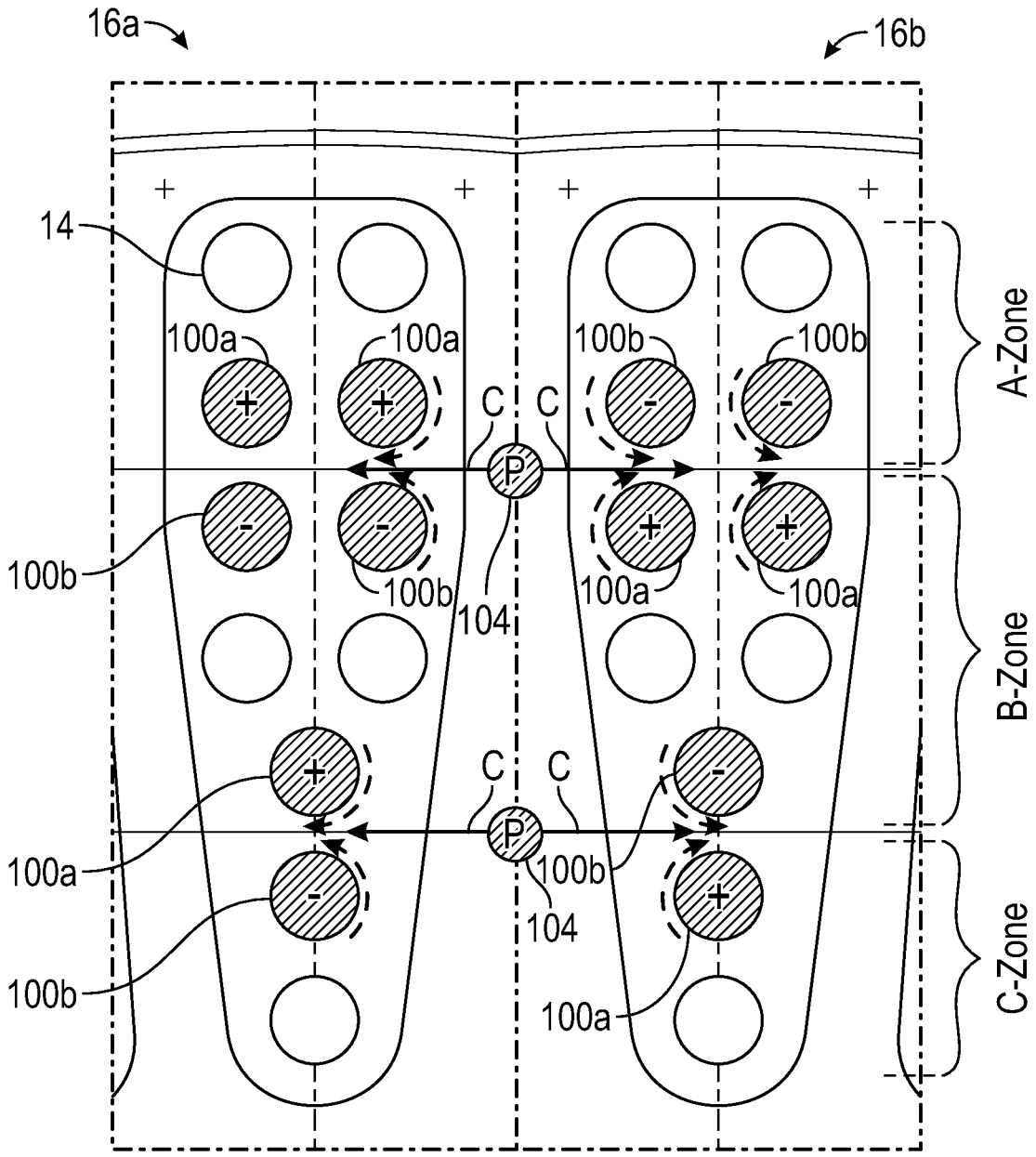
FIG. 15A shows a schematic front view of a plurality of premixer arrays, according to an embodiment of the present disclosure.
Figure 15B:
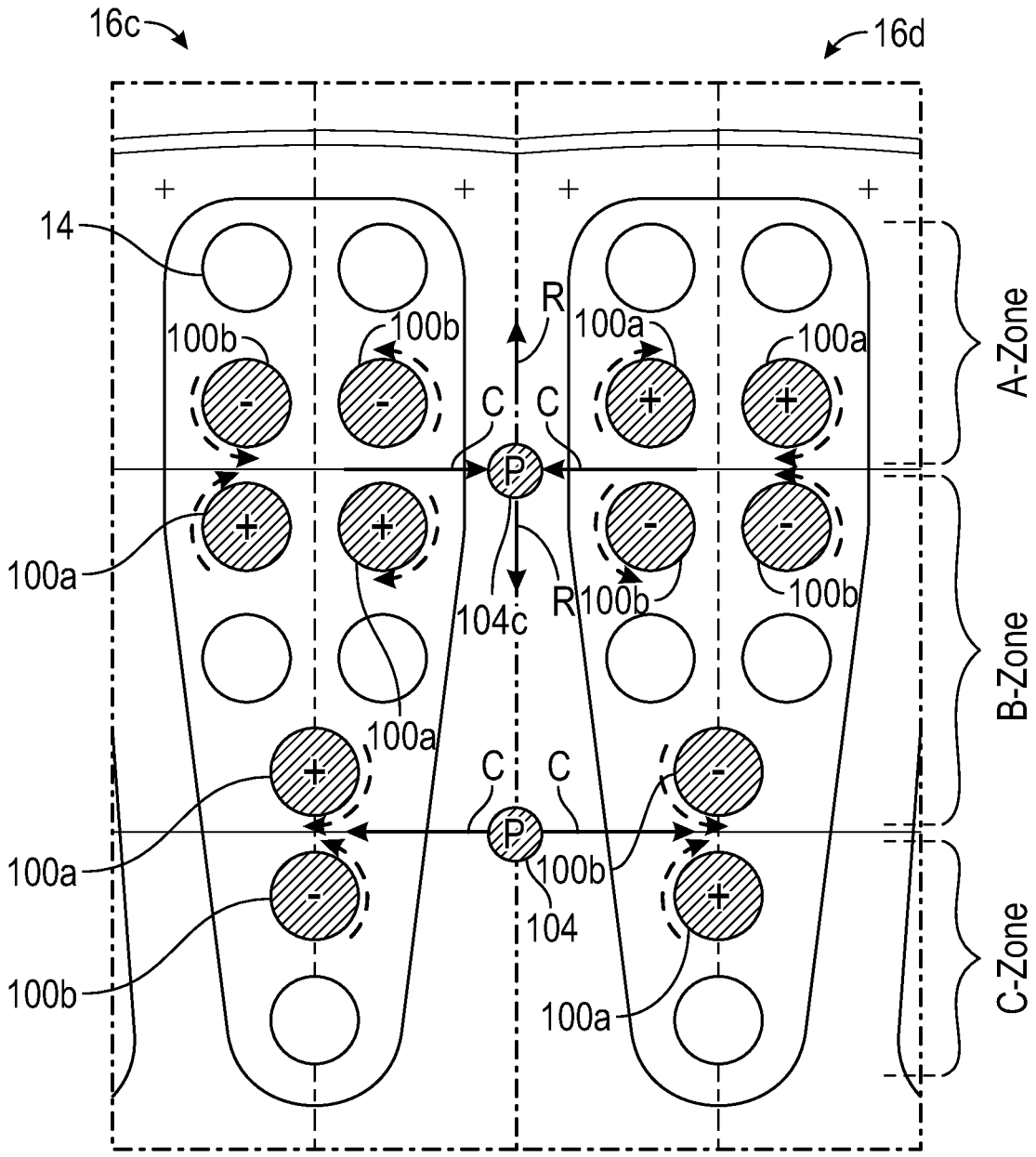
FIG. 15B shows a schematic front view of a plurality of premixer arrays, according to an embodiment of the present disclosure.
Figure 15C:
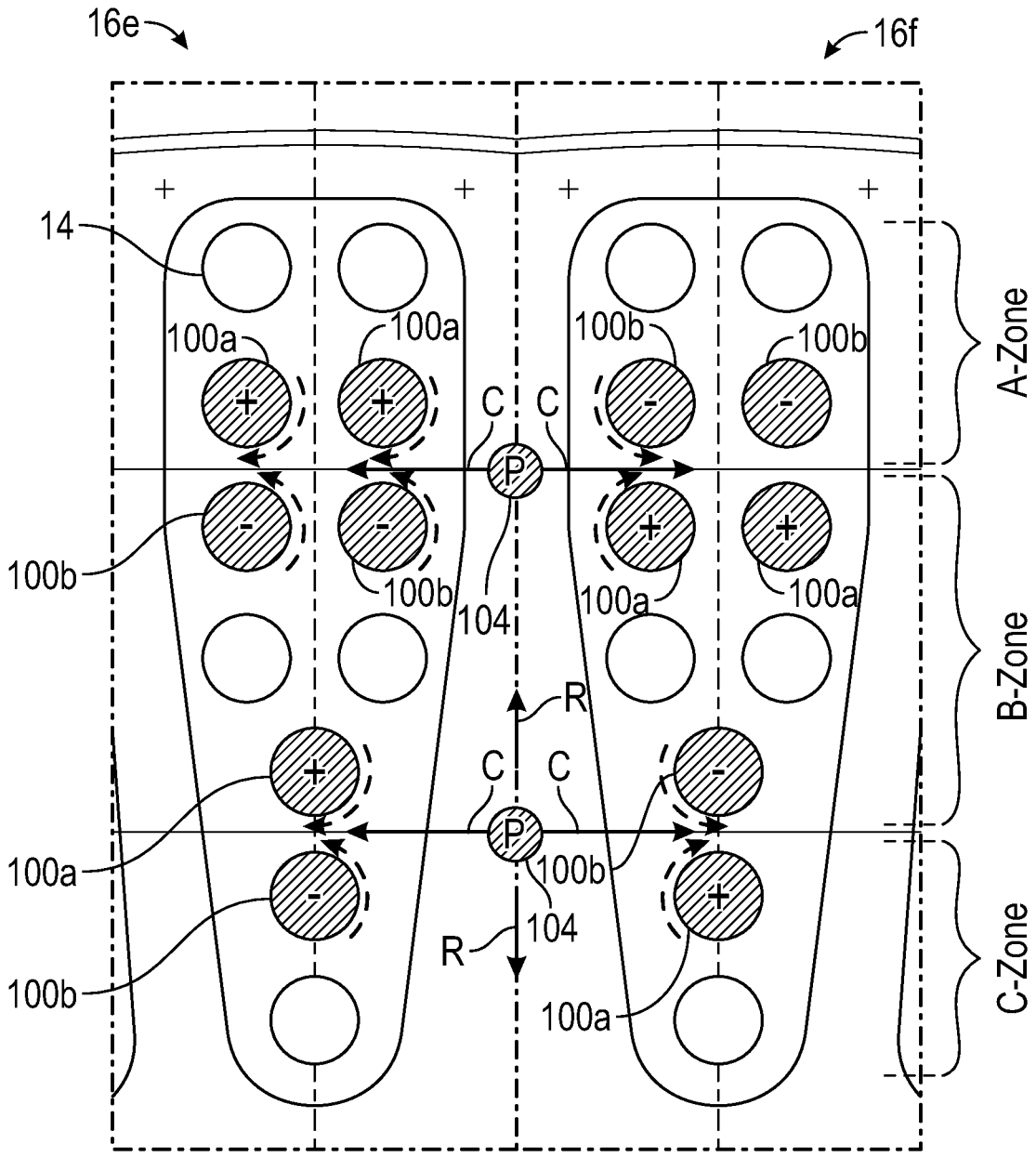
FIG. 15C shows a schematic front view of a plurality of premixer arrays, according to an embodiment of the present disclosure.

In the example of FIGS. 15A to 15C, the pilots 104 may be located between adjacent premixer arrays 16. The swirled premixer tubes 100 may be arranged such that one or more sets of the swirled premixer tubes 100 pull the pilot products in a circumferential direction C and one or more sets of the swirled premixer tubes 100 pull the pilot products in a radial direction R. For example, premixer array 16*a*, premixer array 16*b*, and the left side swirled premixer tubes 100 of premixer array 16*c* may be arranged such that these premixers pull the combustion products from the pilot tube 104 circumferentially in the direction C toward a central pilot tube 104*c*. Similarly, the premixer array 16*f*, premixer array 16*e*, and the right side swirled premixer tubes 100 of premixer array 16*d* may be arranged such that these premixers pull the combustion products from the pilot tube 104 circumferentially in the direction C toward the central pilot tube 104*c* (e.g., in a circumferentially opposite direction as premixer array 16*a*, premixer array 16*b*, and premixer array 16*c*). The right side swirled premixer tubes 100 of premixer array 16*c* and the left side swirled premixer tubes 100 of premixer array 16*d* may pull the combustion products from the circumferential flow and from the central pilot tube 104*c* in a radial direction R. A similar arrangement may be provided with the swirled premixer tubes 100 spanning the B-Zone and the C-Zone to pull the combustion products in a circumferential direction C.

The arrangement of FIGS. 15A to 15C may provide a combination of a radial flow direction and a circumferential flow direction of pilot combustion products induced by a combination of a co-flowing main mixer and a counter-flowing flowing main mixer may improve flame propagation and flame stability. The pilot for radial flow may be situated between main mixers of adjacent premixer assemblies. The products of combustion are further extended circumferentially towards a second premixer assembly to the right and/or the left from the pilot location. The products of combustion then flow radially between adjacent premixer assemblies.

Figure 16A:
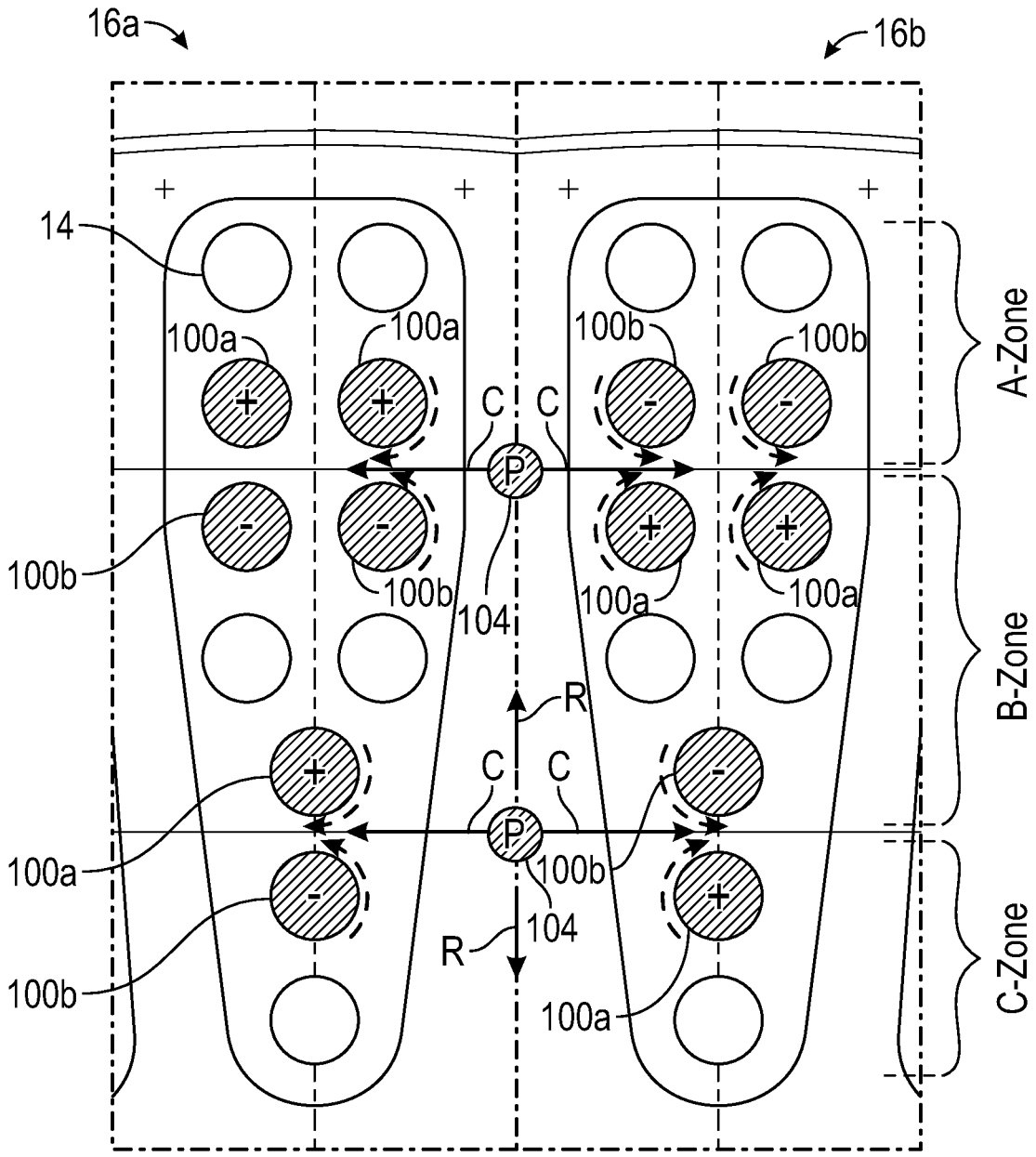
FIG. 16A shows a schematic front view of a plurality of premixer arrays, according to an embodiment of the present disclosure.
Figure 16B:
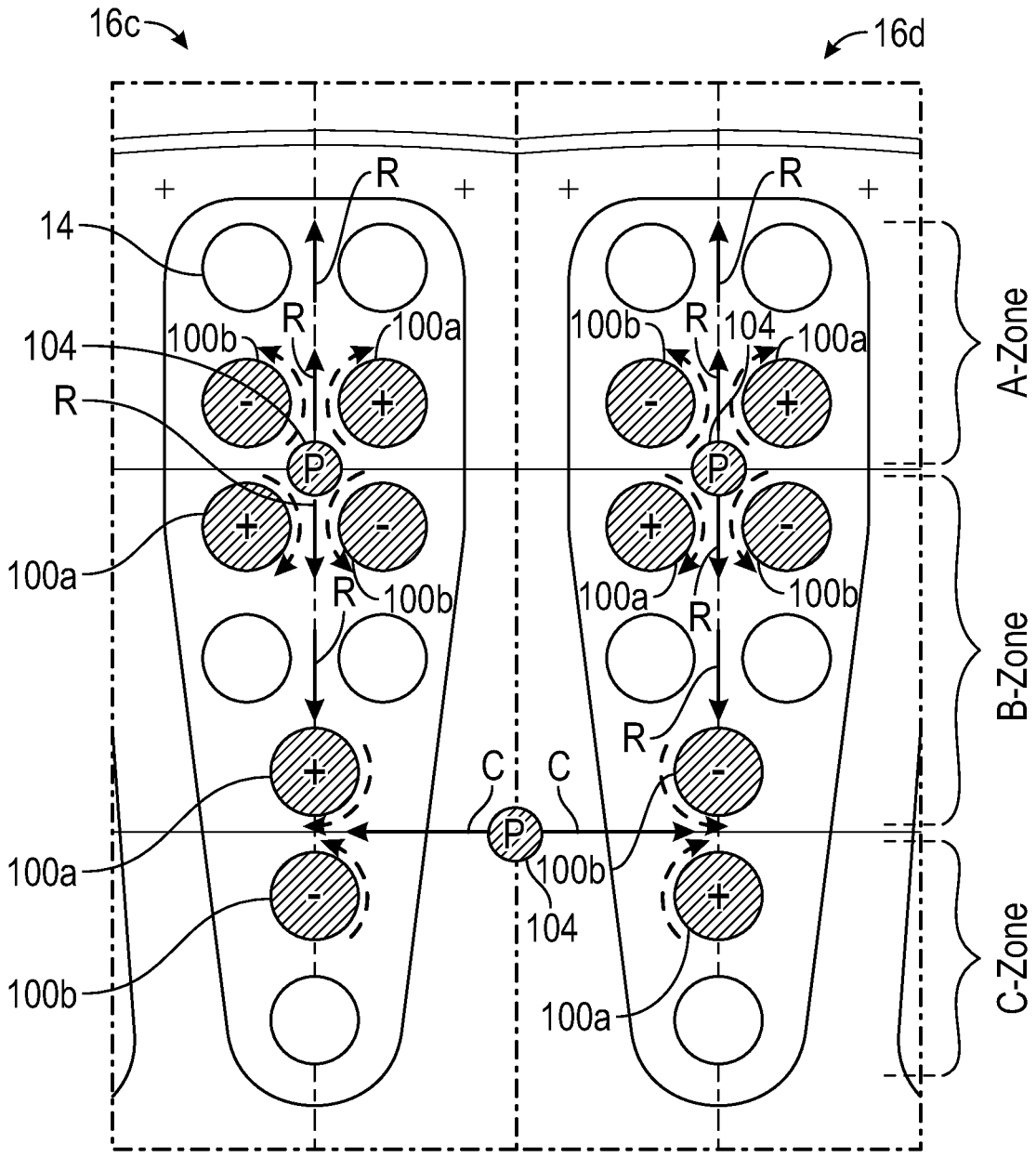
FIG. 16B shows a schematic front view of a plurality of premixer arrays, according to an embodiment of the present disclosure.
Figure 16C:
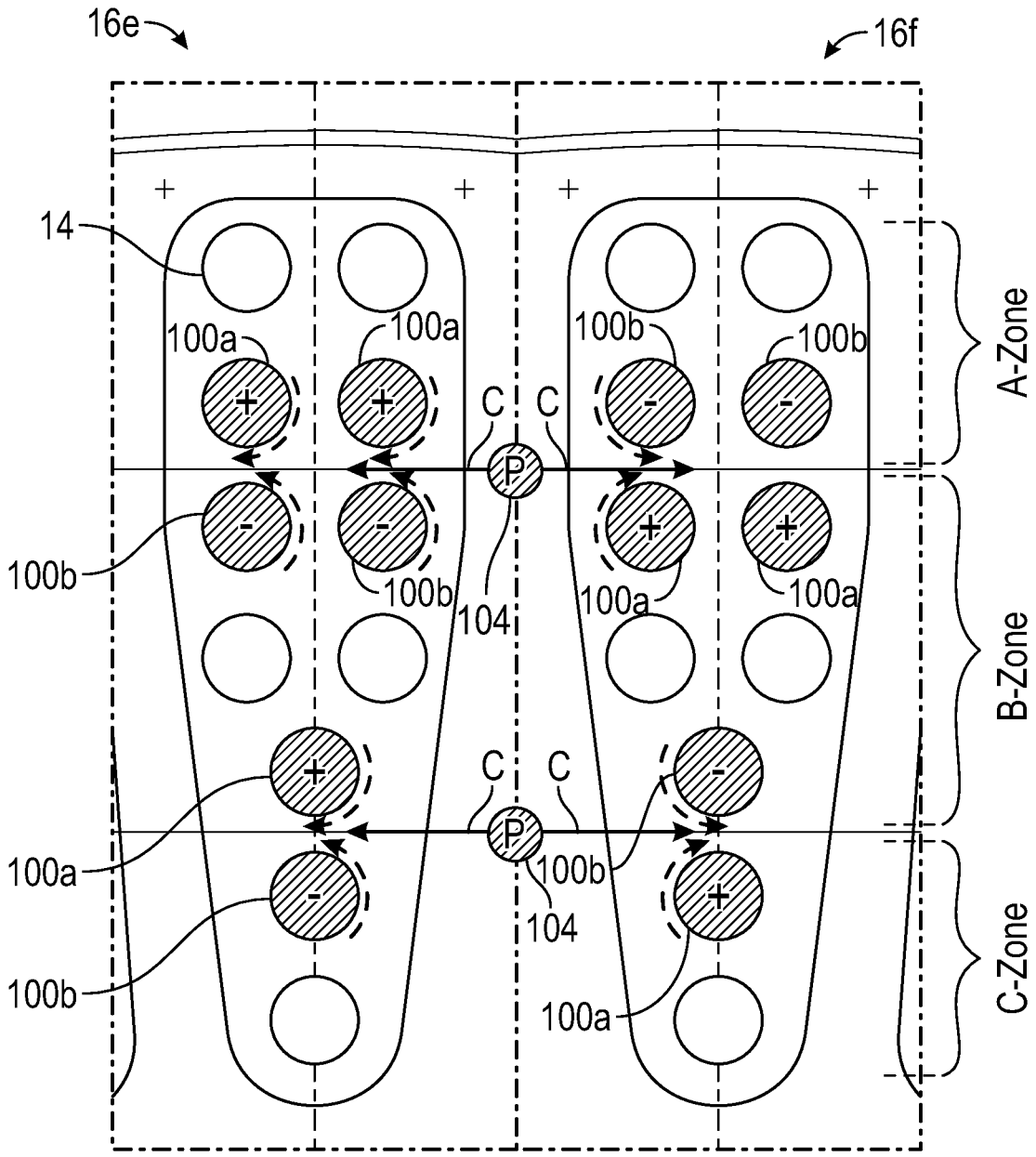
FIG. 16C shows a schematic front view of a plurality of premixer arrays, according to an embodiment of the present disclosure.

FIGS. 16A to 16C show an example of adjacent premixer arrays 16. As shown, the pilot tubes 104 may be provided between adjacent premixer arrays 16 (e.g., between premixer array 16*a* and premixer array 16*b*, between premixer array 16*c* and premixer array 16*d*; and/or between premixer array 16*e* and premixer array 16*f*). The pilot tubes 104 may also be provided within a premixer array 16 (e.g., within premixer array 16*c* and premixer array 16*d*). The arrangement of clockwise swirled premixer tubes 100*a* and counterclockwise swirled premixer tubes 100*b* may induce flow of the pilot products circumferentially in the direction C, radially in the direction R, or both circumferentially and radially. The combination of a radial flow direction and a circumferential flow direction of pilot combustion products induced by the combination of a co-flowing main mixer and a counter-flowing main mixer may improve flame propagation and flame stability. The pilot for radial flow may be situated between main mixers of the same premixer assembly. The products of combustion flow radially between adjacent main mixers of the same premixer assembly.

Figure 17:
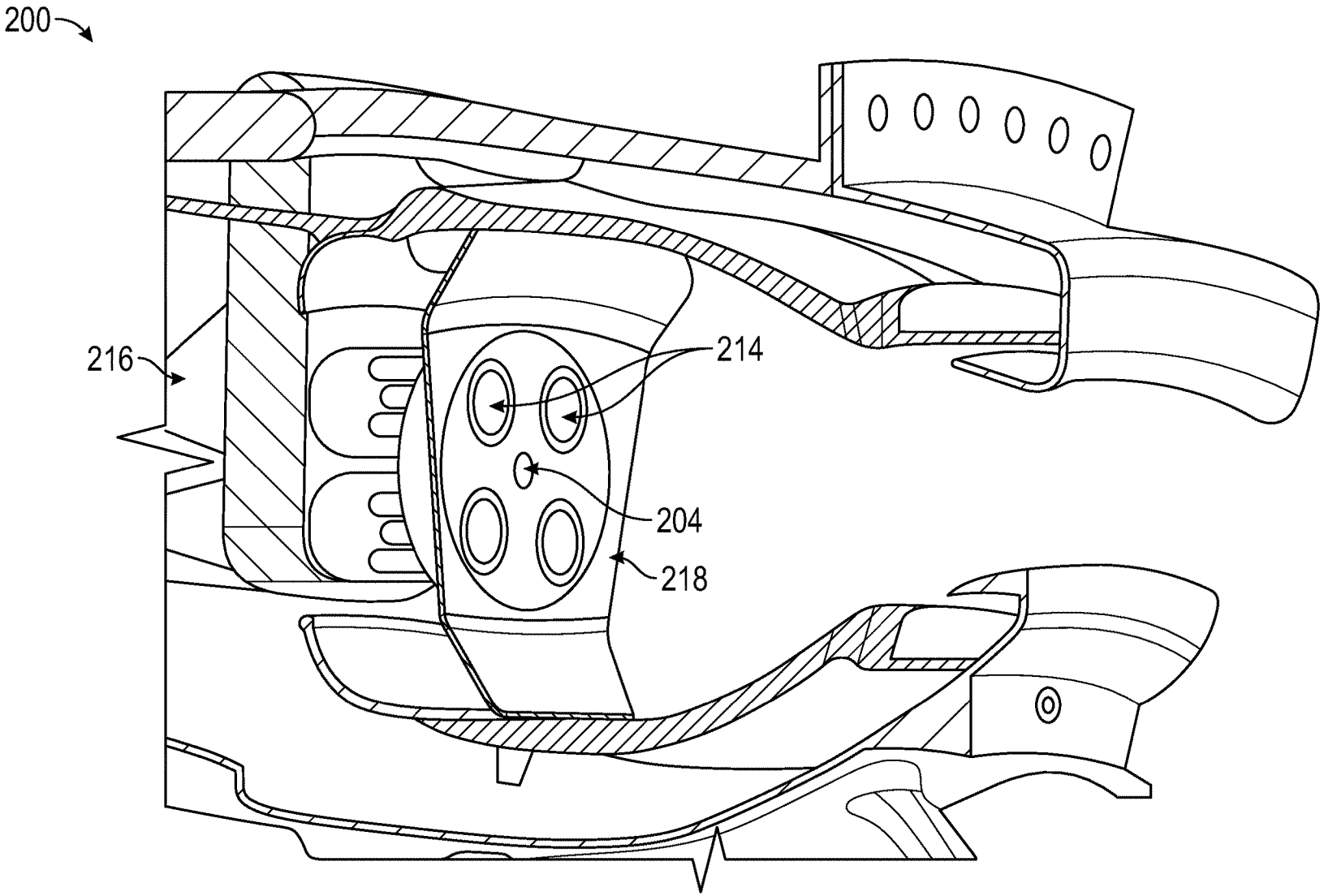
FIG. 17 shows a perspective view of a mixer, according to an embodiment of the present disclosure.

FIGS. 17 to 21 show exemplary mixer arrays for an annular combustor 218. Referring first to FIG. 17, an annular combustor 200 is shown with a mixer array 216 including a plurality of mixers 214 and a pilot tube 204. Although FIG. 17 shows an arrangement of four mixers 214 and one pilot tube 204, the mixer array 216 may extend annularly around the combustor, such as is described in FIGS. 18 to 21.

Figure 18:
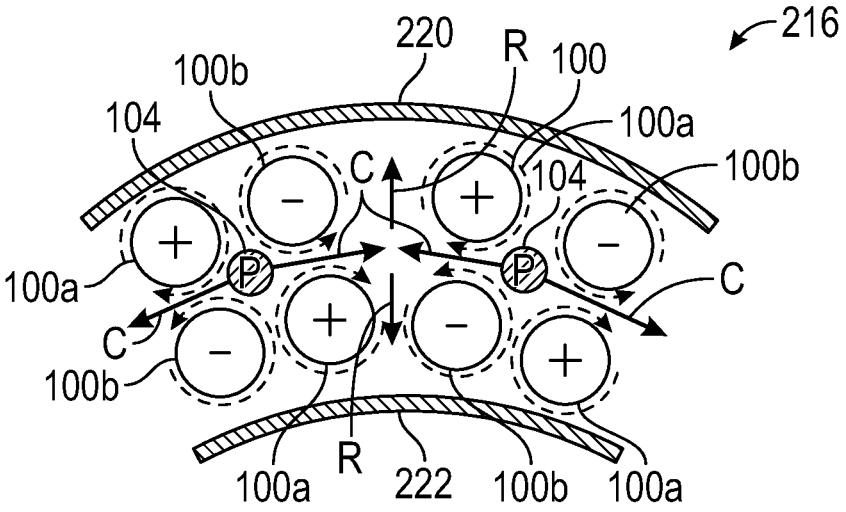
FIG. 18 shows a schematic front view of a plurality of premixer arrays, according to an embodiment of the present disclosure.

FIG. 18 shows an exemplary mixer array 216 for an annular combustor 218 (FIG. 17). The annular combustor 218 may include an outer liner 220 and an inner liner 222. The mixer array 216 may include a plurality of swirled premixer tubes 100. The swirled premixer tubes 100, such as clockwise swirled premixer tubes 100*a* and counterclockwise swirled premixer tubes 100*b* may be arranged between the inner liner 222 and the outer liner 220. The mixer array 216 may include one or more pilot tubes 104 (which may be the same as pilot tube 204). As described previously, the swirled premixer tubes 100 may be arranged to pull the pilot products circumferentially in the direction C and/or radially in the direction R. The arrangement of FIG. 18 allows the circumferential spread of hot products from the pilot tube 104 to adjacent main tubes. The arrangement of FIG. 18 may improve circumferential flame propagation.

Figure 19:
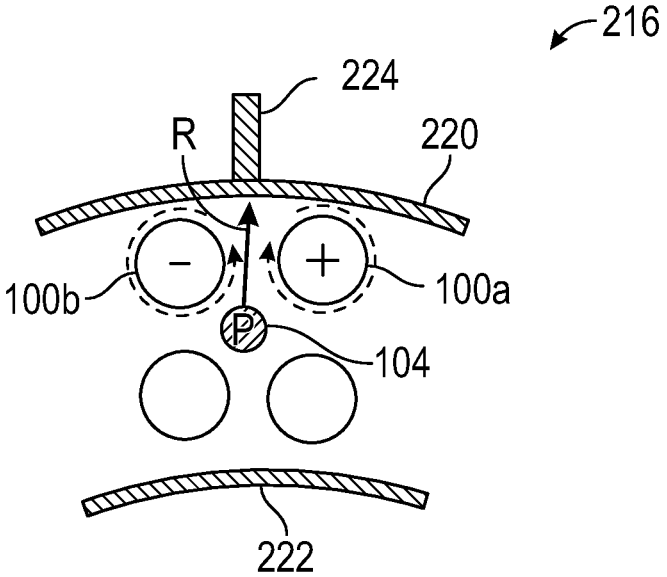
FIG. 19 shows a schematic front view of a plurality of premixer arrays, according to an embodiment of the present disclosure.

In FIG. 19, the mixer array 216 may include swirled premixer tubes 100 arranged to pull the pilot products from the pilot tube 104 in a radial direction R toward an ignitor 224. This may allow for the pilot flow to be pushed toward the ignitor 224 to assist or to enhance ignition.

Figure 20:
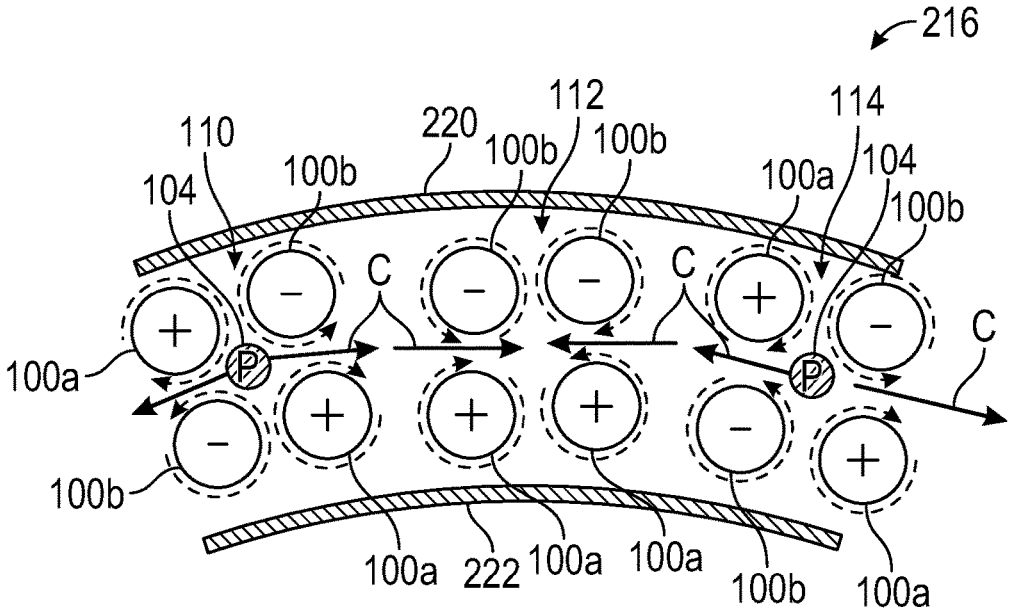
FIG. 20 shows a schematic front view of a plurality of premixer arrays, according to an embodiment of the present disclosure.

In FIG. 20, the mixer array 216 allows for the elimination of every other pilot tube. The ability of the swirled premixer tubes 100 to be arranged to provide circumferential flow in the direction C allows for alternate pilot tubes to be omitted or eliminated. This occurs because the arrangement creates central couplets to drive the pilot products toward the center. This reduces the total number of pilot tubes 104 required in the premixer array 16.

For example, FIG. 20 may include a first subset of premixer tubes 110, a second subset of premixer tubes 112, and a third subset of premixer tubes 114. Each of the subset of premixer tubes may include four swirled premixer tubes arranged in the manner shown in FIG. 20. Each of the first subset of premixer tubes 110 and the third subset of premixer tubes 114 may include a pilot tube 104. The second subset of premixer tubes 112 may not include a pilot tube. The first subset of premixer tubes 110 may extend and spread the pilot flow from the pilot tube 104 in a circumferential direction beyond the first subset of premixer tubes 110 and into the adjacent second subset of premixer tubes 112. Similarly, the third subset of premixer tubes 114 may extend and spread the pilot flow from the pilot tube 104 in a circumferential direction beyond the third subset of premixer tubes 114 and into the adjacent second subset of premixer tubes 114. This pattern may be repeated about the annular combustor 200 (FIG. 17). The second subset of premixer tubes 112 may be adjacent and in-between the first subset of premixer tubes 110 and the third subset of premixer tubes 114. In this manner, the required flame propagation for operation of the combustor may be achieved with fewer pilots, as every other pilot tube 104 may be omitted.

Figure 21:
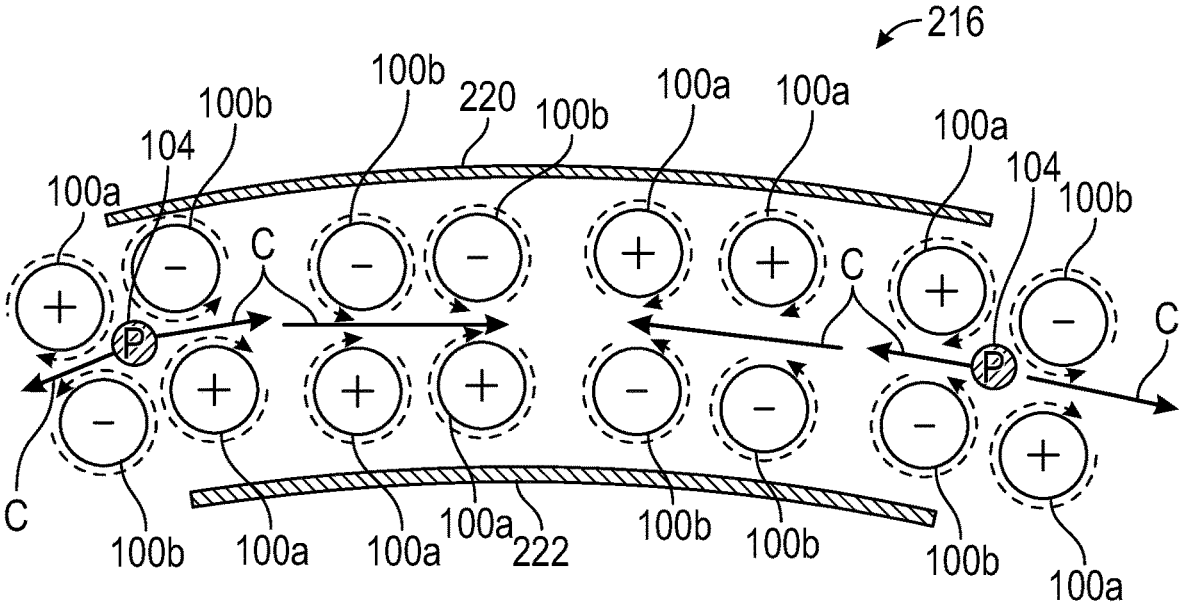
FIG. 21 shows a schematic front view of a plurality of premixer arrays, according to an embodiment of the present disclosure.

In FIG. 21, the mixer array 216 allows for the limitation of two of every four pilot tubes 104. Each pilot tubes 104 feeds two adjacent main couplets. The ability of the swirled premixer tubes 100 to be arranged to provide circumferential flow in the direction C allows for the pilot tubes to be omitted or eliminated.

The mixer arrays described herein may be provided in a variety of arrangements to achieve a desired flow direction of each mixer array or of multiple mixer arrays. For example, the premixer array may include a first premixer array and a second premixer array. The first premixer array may produce a clockwise flow and the second premixer array may produce a counterclockwise flow. That is, the premixer array may include two or more premixer arrays, wherein half of the two or more premixer arrays produce a clockwise flow and one of the two or more premixer arrays produces a counterclockwise flow. For example, where two mixer arrays are present, one premixer array has a clockwise flow and one premixer array has a counterclockwise flow, when four premixer arrays are present two premixer arrays form a clockwise flow and one premixer array forms a counterclockwise flow, and so on.

Accordingly, the premixer array of the present disclosure provides for a pilot introduced between main mixer swirl couplets to provide enhanced radial spread of product of combustion from pilot tubes to flow towards both upper sides and lower sides of the main mixer cluster or tubes. Upward (e.g., radially outward) pilot flow may be induced using a combination of clockwise left swirler tubes and anticlockwise (or counterclockwise) right swirler tubes. Downward (e.g., radially inward) pilot flow may be induced using a combination of counterclockwise left swirler tubes and clockwise right swirler tubes. This may provide stable ignition source to main tubes or a cluster of main tubes. Circumferential flow may be eliminated in some examples. The direction of flow of the pilot products may be controlled by placement of the swirled premixer tubes and by selection of counterclockwise or clockwise angled tangential openings in the premixer tubes.

According to the present disclosure, the premixer arrays may reduce a recirculation zone, reduce temperature of the liner, stabilize the flame structure, move the flow closer to the outer liner to fill the recirculation zone, and/or move the flow closer to the inner liner to reduce the temperature on the liner.

According to the present disclosure, a combination of clockwise and counterclockwise, lightly swirled premixer tubes may create a secondary flow structure that positively impacts the heat release near the dome and heat shield, which may provide a combustion dynamics benefit.

According to the present disclosure swirl couplets (e.g., swirled premixer tubes) may be provided close to an outer liner and/or inner liner of the combustion zone to reduce a corner circulation zone near the liner. This may reduce flame quenching, may lower CO emissions, and may lower the liner temperature.

According to the present disclosure, a swirling pilot and/or a non-swirling pilot may be introduced between non-swirling premixer tubes or swirling premixer tubes to cause products of combustion from the pilot to flow toward adjacent premixer tubes or adjacent clusters of premixer tubes or adjacent premixer arrays. This may provide enhanced flame stability.

According to the present disclosure, couplets (e.g., premixer tubes) may be put on any row and/or column of the premixer array and/or between adjacent premixer zones (e.g., between the A-Zone and the B-Zone, or the A-Zone, or the B-Zone) and/or between adjacent premixers.

According to the present disclosure, a pilot flame temperature may be maintained the same as the main tubes at higher power mode to achieve a lower emission. The pilot flame temperature may be maintained at 50° F. to 500° F. higher than the main flame temperature to achieve better operability at lower power modes.

According to the present disclosure, a gas pilot and/or a liquid pilot may be introduced at a center region of a cluster/subset and/or a zone of premixers and/or between two adjacent zones of the premixer array.

According to the present disclosure, tangential slots may be introduced to the post forward and aft air holes to achieve a swirl number between 0.05 and 0.40. This may achieve compact flame structure as compared to non-swirling premixer tubes, which may result in an emissions benefit. The non-swirling forward and/or aft holes with swirling vanes in a premixer may generate higher turbulent levels within the premixer due to the shear created between the non-swirling and swirling flow within the premixer itself. Between forward/aft mixing may result in lower $NO_x$ emissions.

Further aspects of the present disclosure are provided by the subject matter of the following clauses.

A premixer array for a gas turbine engine, the premixer array including one or more pilot tubes configured to cause a pilot product to flow and a plurality of swirled premixer tubes being configured to guide and to spread out the pilot product in a radial direction, in a circumferential direction, or both in the radial direction and the circumferential direction.

The premixer array of any preceding clause, further comprising a plurality of non-swirled premixer tubes for providing a fuel-air mixture to the combustion section.

The premixer array of any preceding clause, further comprising an A-Zone, a B-Zone, and a C-Zone, wherein the A-Zone, the B-Zone, the C-Zone, or a combination thereof, includes at least one swirled premixer tube of the plurality of swirled premixer tubes.

The premixer array of any preceding clause, the plurality of swirled premixer tubes including a subset of swirled premixer tubes, the subset of swirled premixer tubes comprising a first clockwise swirled premixer tube, a second clockwise swirled premixer tube, a first counterclockwise swirled premixer tube, and a second counterclockwise swirled premixer tube.

The premixer array of any preceding clause, wherein the first clockwise swirled premixer tube is located adjacent to the first counterclockwise swirled premixer tube such that a first fuel-air mixture flow exiting the first clockwise swirled premixer tube is opposed to a second fuel-air mixture flow exiting the first counterclockwise swirled premixer tube to form an opposed fuel-air mixture flow, and wherein the opposed fuel-air mixture flow guides the pilot product in the radial direction.

The premixer array of any preceding clause, wherein the subset of swirled premixer tubes is located in a B-Zone of the premixer array, and wherein the subset of swirled premixer tubes is configured to guide the pilot product radially outward and radially inward.

The premixer array of any preceding clause, wherein the subset of swirled premixer tubes is located in an A-Zone of the premixer array, and wherein the subset of swirled premixer tubes is configured to guide the pilot product radially outward and radially inward.

The premixer array of any preceding clause, wherein the subset of swirled premixer tubes is arranged in a square in plan view and wherein the one or more pilot tubes is located in a center of the square.

The premixer array of any preceding clause, wherein the subset of swirled premixer tubes is configured to guide the pilot product to an adjacent subset of swirled premixer tubes, and wherein the adjacent subset of swirled premixer tubes does not include a pilot tube.

The premixer array of any preceding clause, further comprising at least one C-Zone swirled premixer tube located radially below the subset of swirled premixer tubes, the at least one C-Zone swirled premixer tube configured to guide the pilot product toward an inner liner of the gas turbine engine.

The premixer array of any preceding clause, further comprising at least one A-Zone swirled premixer tube located radially above the subset of swirled premixer tubes, the at least one A-Zone swirled premixer tube configured to guide the pilot product toward an outer liner of the gas turbine engine.

The premixer array of any preceding clause, wherein the subset of swirled premixer tubes spans a first Zone and a second Zone of the premixer array.

The premixer array of any preceding clause, wherein the subset of swirled premixer tubes is configured to guide the pilot product circumferentially within an annular combustor of the gas turbine engine.

The premixer array of any preceding clause, wherein the subset of swirled premixer tubes is configured to guide the pilot product toward an ignitor.

The premixer array of any preceding clause, wherein the subset of swirled premixer tubes is configured to guide the pilot product to an adjacent subset of swirled premixer tubes.

The premixer array of any preceding clause, wherein at least one of the plurality of swirled premixer tubes is configured to guide the pilot product to an inner liner or an outer liner of the combustion section of the gas turbine engine.

The premixer array of any preceding clause, wherein the plurality of swirled premixer tubes comprises at least one clockwise swirled premixer tube that includes tangential openings angled in a clockwise direction such that a flow through the tangential openings exits the at least one clockwise swirled premixer tube in a clockwise manner.

The premixer array of any preceding clause, wherein the plurality of swirled premixer tubes comprises at least one counterclockwise swirled premixer tube that includes tangential openings angled in a counterclockwise direction such that a flow through the tangential openings exits the at least one counterclockwise swirled premixer tube in a counterclockwise manner.

The premixer array of any preceding clause, wherein the one or more pilot tubes is located within the premixer array or in between adjacent premixer arrays.

The premixer array of any preceding clause, the plurality of swirled premixer tubes further comprising a first subset of premixer tubes, a second subset of premixer tubes, and a third subset of premixer tubes, wherein the first subset of premixer tubes includes a first pilot tube, the second subset of premixer tubes includes no pilot tube, and the third subset of premixer tubes includes a second pilot tube, and wherein, the first subset of premixer tubes is configured to extend a first flow from the first pilot tube in a circumferential direction beyond the first subset of premixer tubes and into the second subset of premixer tubes, and the third subset of premixer tubes is configured to extend a second flow from the second pilot tube in a circumferential direction beyond the third subset of premixer tubes and into the second subset of premixer tubes.

The premixer array of any preceding clause, wherein the second subset of premixer tubes is adjacent and in-between the first subset of premixer tubes and the third subset of premixer tubes.

The premixer array of any preceding clause, wherein the premixer array comprises a first premixer array and a second premixer array, the first premixer array producing a clockwise flow and the second premixer array producing a counterclockwise flow.

The premixer array of any preceding clause, wherein the premixer array comprises two or more premixer arrays provided in multiples of two, wherein half of the two or more premixer arrays produce a clockwise flow and one of the two or more premixer arrays produces a counterclockwise flow.

The premixer array of any preceding clause, wherein the one or more pilot tubes includes a gas pilot tube, a liquid pilot tube, or both a gas pilot tube and a liquid pilot tube.

The premixer array of any preceding clause, wherein the one or more pilot tubes includes multiple gas pilot tubes, multiple liquid pilot tubes, or both multiple gas pilot tubes and multiple liquid pilot tubes introduced at a center region of a subset of premixers.

The premixer array of any preceding clause, wherein the one or more pilot tubes includes multiple gas pilot tubes, multiple liquid pilot tubes, or both multiple gas pilot tubes and multiple liquid pilot tubes introduced between a first subset of premixers and a second, adjacent subset of premixers.

A premixer array for a combustion section of an engine including a plurality of swirled premixer tubes having one or more tangential openings and being configured for providing a swirled flow to a fuel-air mixture therethrough and one or more non-swirled premixer tubes omitting the one or more tangential openings and being configured for providing a non-swirled flow to a fuel-air mixture therethrough. The swirled flow is in a clockwise direction when the one or more tangential openings are angled in a clockwise direction or in a counterclockwise direction when the one or more tangential openings are angled in a counterclockwise direction.

The premixer array of any preceding clause, further comprising one or more pilot tubes configured to cause a pilot product to flow, wherein the plurality of swirled premixer tubes being configured to guide and to spread out the pilot product in a radial direction, in a circumferential direction, or both in the radial direction and the circumferential direction.

The premixer array of any preceding clause, further comprising an A-Zone, a B-Zone, and a C-Zone, wherein the A-Zone, the B-Zone, the C-Zone, or a combination thereof, includes at least one swirled premixer tube of the plurality of swirled premixer tubes.

The premixer array of any preceding clause, wherein at least one of the plurality of swirled premixer tubes is configured to guide the pilot product to an inner liner or an outer liner of the combustion section of the engine.

The premixer array of any preceding clause, wherein the premixer array comprises two or more premixer arrays provided in multiples of two, and wherein half of the two or more premixer arrays produce a clockwise flow and one of the two or more premixer arrays produces a counterclockwise flow.

The premixer array of any preceding clause, wherein the one or more pilot tubes is located within the premixer array or in between adjacent premixer arrays, and wherein the one or more pilot tubes includes a gas pilot tube, a liquid pilot tube, or both a gas pilot tube and a liquid pilot tube.

The premixer array of any preceding clause, wherein the one or more pilot tubes includes multiple gas pilot tubes, multiple liquid pilot tubes, or both multiple gas pilot tubes and multiple liquid pilot tubes introduced at a center region of a subset of premixers or introduced between a first subset of premixers and a second, adjacent subset of premixers.

The premixer array of any preceding clause, the plurality of swirled premixer tubes including a subset of swirled premixer tubes, the subset of swirled premixer tubes comprising a first clockwise swirled premixer tube, a second clockwise swirled premixer tube, a first counterclockwise swirled premixer tube, and a second counterclockwise swirled premixer tube.

The premixer array of any preceding clause, wherein the first clockwise swirled premixer tube is located adjacent to the first counterclockwise swirled premixer tube such that a first fuel-air mixture flow exiting the first clockwise swirled premixer tube is opposed to a second fuel-air mixture flow exiting the first counterclockwise swirled premixer tube to form an opposed fuel-air mixture flow, and wherein the opposed fuel-air mixture flow guides the pilot product in the radial direction.

The premixer array of any preceding clause, wherein the subset of swirled premixer tubes is located in an A-Zone or in a B-Zone of the premixer array, and wherein the subset of swirled premixer tubes is configured to guide the pilot product radially outward and radially inward.

The premixer array of any preceding clause, wherein the subset of swirled premixer tubes is arranged in a square in plan view and wherein the one or more pilot tubes is located in a center of the square.

The premixer array of any preceding clause, wherein the subset of swirled premixer tubes is configured to guide the pilot product to an adjacent subset of swirled premixer tubes, and wherein the adjacent subset of swirled premixer tubes does not include a pilot tube.

The premixer array of any preceding clause, further comprising at least one C-Zone swirled premixer tube located radially below the subset of swirled premixer tubes, the at least one C-Zone swirled premixer tube configured to guide the pilot product toward an inner liner of the engine.

The premixer array of any preceding clause, further comprising at least one A-Zone swirled premixer tube located radially above the subset of swirled premixer tubes, the at least one A-Zone swirled premixer tube configured to guide the pilot product toward an outer liner of the engine.

The premixer array of any preceding clause, wherein the subset of swirled premixer tubes spans a first Zone and a second Zone of the premixer array.

The premixer array of any preceding clause, wherein the subset of swirled premixer tubes is configured to guide the pilot product circumferentially within an annular combustor of the engine.

The premixer array of any preceding clause, wherein the subset of swirled premixer tubes is configured to guide the pilot product toward an ignitor or to an adjacent subset of swirled premixer tubes.

The premixer array of any preceding clause, the plurality of swirled premixer tubes further comprising a first subset of premixer tubes, a second subset of premixer tubes, and a third subset of premixer tubes, wherein the first subset of premixer tubes includes a first pilot tube, the second subset of premixer tubes includes no pilot tube, and the third subset of premixer tubes includes a second pilot tube, and wherein, the first subset of premixer tubes is configured to extend a first flow from the first pilot tube in a circumferential direction beyond the first subset of premixer tubes and into the second subset of premixer tubes, and the third subset of premixer tubes is configured to extend a second flow from the second pilot tube in a circumferential direction beyond the third subset of premixer tubes and into the second subset of premixer tubes.

The premixer array of any preceding clause, wherein the second subset of premixer tubes is adjacent and in-between the first subset of premixer tubes and the third subset of premixer tubes.

A method of controlling a flow of pilot products from a pilot tube including providing an opposed fuel-air mixture flow from a clockwise fuel-air mixture flow and a counterclockwise fuel-air mixture flow in a mixer array, providing a flow of pilot products in the mixer array, guiding, with the opposed fuel-air mixture flow, the flow of pilot products in a radial direction, in a circumferential direction, or in both a radial direction and a circumferential direction; and spreading, with the opposed fuel-air mixture flow, the flow of pilot products.

Although the foregoing description is directed to the preferred embodiments, it is noted that other variations and modifications will be apparent to those skilled in the art, and may be made without departing from the spirit or scope of the disclosure Moreover, features described in connection with one embodiment may be used in conjunction with other embodiments, even if not explicitly stated above.

The invention claimed is:

1. An annular mixer for a gas turbine engine, the annular mixer being located directly upstream, in a flow direction, of a combustion section of the gas turbine engine, such that, during operation of the gas turbine engine, the annular mixer provides a pilot fuel and a fuel-air mixture to the combustion section, the annular mixer comprising:

a plurality of premixer arrays arranged in a circumferential direction of the annular mixer, the plurality of premixer arrays defining an A-Zone, a B-Zone, and a C-Zone of the annular mixer that each extend in the circumferential direction with the A-Zone being adjacent to an outer liner of the combustion section, the B-Zone being disposed radially inward of the A-Zone along a radial direction, and the C-Zone being disposed radially inward of the B-Zone along the radial direction and adjacent to an inner liner of the combustion section, each premixer array of the plurality of premixer arrays comprising:

a premixer array mounting plate coupled to a bulkhead wall of the combustion section that extends between the inner liner and the outer liner, the premixer array mounting plate defining a plurality of tube ports extending therethrough, the plurality of tube ports being disposed in each of the A-Zone, the B-Zone, and the C-Zone;

one or more pilot fuel tubes coupled to the premixer array mounting plate via one or more pilot tube ports of the plurality of tube ports and configured to provide the pilot fuel to the annular mixer;

one or more non-swirled premixer tubes coupled to the premixer array mounting plate via one or more non-swirled premixer tube ports of the plurality of tube ports and configured to provide the fuel-air mixture to the annular mixer that mixes with the pilot fuel, a first non-swirled premixer tube of the one or more non-swirled premixer tubes being located in the B-Zone, and a second non-swirled premixer tube of the one or more non-swirled premixer tubes being located in the C-Zone adjacent to the first non-swirled premixer tube; and a plurality of swirled premixer tubes coupled to a plurality of swirled premixer tube ports of the plurality of tube ports and configured to provide the fuel-air mixture to the annular mixer that mixes with the pilot fuel, the plurality of swirled premixer tubes including:

a first subset of swirled premixer tubes located in the A-Zone and configured to guide the pilot fuel radially outward along the radial direction toward the outer liner of the combustion section, a first pilot fuel tube of the one or more pilot fuel tubes being located in a center of the first subset of swirled premixer tubes;

a second subset of swirled premixer tubes located in the B-Zone and configured to guide the pilot fuel radially inward along the radial direction toward the first non-swirled premixer tube and the C-Zone; and a single swirled premixer tube located in the C-Zone and configured to guide the pilot fuel radially inward along the radial direction toward the inner liner of the combustion section.

2. The annular mixer of claim 1, wherein, in each premixer array of the plurality of premixer arrays, the single swirled premixer tube located in the C-Zone guides the pilot fuel along the radial direction away from the second non-swirled premixer tube.

3. The annular mixer of claim 1, wherein, in each premixer array of the plurality of premixer arrays, at least one of the plurality of swirled premixer tubes is configured to guide the pilot fuel to the inner liner or the outer liner of the combustion section.

4. The annular mixer of claim 1, wherein, in each premixer array of the plurality of premixer arrays, the first subset of swirled premixer tubes, the second subset of swirled premixer tubes, or both, comprises at least one clockwise swirled premixer tube that includes first tangential openings angled in a clockwise direction such that a first flow of the fuel-air mixture through the first tangential openings exits the at least one clockwise swirled premixer tube in a clockwise manner and at least one counterclockwise swirled premixer tube that includes second tangential openings angled in a counterclockwise direction such that a second flow of the fuel-air mixture through the second tangential openings exits the at least one counterclockwise swirled premixer tube in a counterclockwise manner.

5. The annular mixer of claim 1, wherein, in each premixer array of the plurality of premixer arrays, at least one of the first subset of swirled premixer tubes or the second subset of swirled premixer tubes comprises a first clockwise swirled premixer tube, a second clockwise swirled premixer tube, a first counterclockwise swirled premixer tube, and a second counterclockwise swirled premixer tube.

6. The annular mixer of claim 5, wherein, in each premixer array of the plurality of premixer arrays, the first clockwise swirled premixer tube is located adjacent to the first counterclockwise swirled premixer tube such that a first flow of the fuel-air mixture exiting the first clockwise swirled premixer tube is opposed to a second flow of the fuel-air mixture exiting the first counterclockwise swirled premixer tube to form an opposed fuel-air mixture flow comprised of the first flow of the fuel-air mixture and the second flow of the fuel-air mixture, and wherein the opposed fuel-air mixture flow guides the pilot fuel in the radial direction.

7. The annular mixer of claim 5, wherein, in each premixer array of the plurality of premixer arrays, the first subset of swirled premixer tubes is configured to guide the pilot fuel from the first pilot fuel tube of the one or more pilot fuel tubes toward the outer liner of the combustion section.

8. The annular mixer of claim 1, wherein, in each premixer array of the plurality of premixer arrays, the second subset of swirled premixer tubes is configured to guide the pilot fuel from a second pilot fuel tube of the one or more pilot fuel tubes radially outward toward the first subset of swirled premixer tubes and radially inward toward the first non-swirled premixer tube and the single swirled premixer tube.

9. The annular mixer of claim 1, wherein, in each premixer array of the plurality of premixer arrays, the first subset of swirled premixer tubes is arranged in a square in plan view, the center of the first subset of swirled premixer tubes being a center of the square.

10. The annular mixer of claim 1, wherein, in each premixer array of the plurality of premixer arrays, the second subset of swirled premixer tubes is configured to guide the pilot fuel from a second pilot fuel tube of the one or more pilot fuel tubes radially outward along the radial direction toward the first subset of swirled premixer tubes.

11. The annular mixer of claim 1, wherein, in each premixer array of the plurality of premixer arrays, each of the first subset of swirled premixer tubes and the second subset of swirled premixer tubes comprises a first clockwise swirled premixer tube, a second clockwise swirled premixer tube, a first counterclockwise swirled premixer tube, and a second counterclockwise swirled premixer tube, and wherein, in each premixer array of the plurality of premixer arrays, the first clockwise swirled premixer tube of the first subset of swirled premixer tubes is adjacent the first counterclockwise swirled premixer tube of the second subset of swirled premixer tubes and the first counterclockwise swirled premixer tube of the first subset of swirled premixer tubes is adjacent the first clockwise swirled premixer tube of the second subset of swirled premixer tubes.

12. The annular mixer of claim 1, wherein each premixer array of the plurality of premixer arrays further comprises a second pilot fuel tube of the one or more pilot fuel tubes that is located in the B-Zone, and wherein, in each premixer array of the plurality of premixer arrays, the second subset of swirled premixer tubes is configured to guide the pilot fuel from the second pilot fuel tube of the one or more pilot fuel tubes radially outward toward the first subset of swirled premixer tubes and radially inward toward the first non-swirled premixer tube and the single swirled premixer tube.

13. The annular mixer of claim 12, wherein, in each premixer array of the plurality of premixer arrays, the first pilot fuel tube is a gas pilot fuel tube and the second pilot fuel tube is a liquid pilot fuel tube.

14. The annular mixer of claim 13, wherein, in each premixer array of the plurality of premixer arrays, the second pilot fuel tube of the one or more pilot fuel tubes is located in a center of the second subset of swirled premixer tubes.

* * * * *